US005475469A

United States Patent [19]

Okada et al.

[11] Patent Number: 5,475,469

[45] Date of Patent: Dec. 12, 1995

[54] IMAGE FORMING EQUIPMENT WITH DEPLETION DETECTION IN AN TONER ENDLESS CIRCULATION PATH

[75] Inventors: Hideki Okada; Kiyoharu Momose; Junichiro Shinozaki; Yoshinori Miyazawa, all of Nagano, Japan

[73] Assignee: Seiko Epson Corporation, Tokyo, Japan

[21] Appl. No.: 324,263

[22] Filed: Oct. 17, 1994

[30] Foreign Application Priority Data

| | | | |
|---|---|---|---|
| Oct. 15, 1993 | [JP] | Japan | 5-258763 |
| Jun. 28, 1994 | [JP] | Japan | 6-169041 |
| Jun. 28, 1994 | [JP] | Japan | 6-169042 |

[51] Int. Cl.[6] ..... G03G 15/08; G03G 21/10

[52] U.S. Cl. ..... 355/203; 355/245; 355/298

[58] Field of Search ..... 355/203, 245, 355/246, 298; 118/653, 652, 688, 693, 694

[56] References Cited

U.S. PATENT DOCUMENTS

| | | | |
|---|---|---|---|
| 3,700,328 | 10/1972 | Davidge et al. | 355/15 |
| 4,011,835 | 3/1977 | Lewis | 118/652 |
| 5,036,358 | 7/1991 | Yoshida | 355/203 |

FOREIGN PATENT DOCUMENTS

| | | | |
|---|---|---|---|
| 58-107572 | 6/1983 | Japan | 355/245 |
| 60-2660 | 1/1985 | Japan . | |
| 63-16742 | 4/1988 | Japan . | |
| 63-246780 | 10/1988 | Japan . | |

*Primary Examiner*—Joan H. Pendegrass

*Attorney, Agent, or Firm*—Sughrue, Mion, Zinn, Macpeak & Seas

[57] ABSTRACT

Image forming equipment, which includes a developing device for supplying toners to the surface of a photosensitive member and developing a latent image on the surface of the photosensitive member to thereby form a toner image; a cleaning device for removing and collecting residual toners adhered to the surface of the photosensitive member after the toner image formed by the developing device is transferred to paper; a toner delivery device interposed in a closed loop between the developing device and cleaning device for delivering part of the surplus toners that have not been used for development in the development device to the cleaning device and for delivering the residual toners collected by the cleaning device to the developing device; and a toner tank for supplying toners to a toner delivery path R of the toner delivery device, is provided. In the image forming equipment, by providing a detection system for detecting the depletion of the toners with respect to the toner delivery path, the residual quantity of toners can be detected positively without increasing the size of the developing device.

21 Claims, 20 Drawing Sheets

IMAGE FORMING EQUIPMENT WITH DEPLETION DETECTION IN AN TONER ENDLESS CIRCULATION PATH

BACKGROUND OF THE INVENTION

1. Field of the Invention

The present invention relates to image forming equipment and, in particular, to image forming equipment such as a printer, a copying machine, a facsimile machine, and the like which use toners to form an image onto recording paper according to an electrophotographic method. The present invention further relates to a technique for detecting the residual quantity of the toners.

2. Description of the Related Art

The present inventors have developed image forming equipment which includes: a developing device which supplies toners to the surface of a photosensitive member and develops a latent image on the surface of the sensitive member to thereby form a toner image; a cleaning device which, after the toner image formed by the developing device is transferred to paper, removes and collects the residual toners attached to the surface of the sensitive member; a toner delivery device, interposed in a closed loop between the developing device and the cleaning device, which delivers a portion of the surplus toners that have not been used for development in the developing device to the cleaning device and delivers the residual toner collected by the cleaning device to the developing device; and toner supply means, which supplies the toners to a toner delivery path of the toner delivery device.

In such image forming equipment, the delivery of the toners is entrusted to the toner delivery device and the toners is supplied to the toner delivery path R, which makes it possible to miniaturize not only the developing device but also the whole image forming equipment and, at the same time, to improve the degree of freedom of the layout to a great extent. Now, in Japanese Patent Publication No. 63-246780 of Showa, there is disclosed image forming equipment which includes: a belt-shaped member interposed between the interior of a developing device as described above and the interior of a cleaning device, which removes and collects the residual toners attached to the surface of the photosensitive drum, the belt-shaped member being driven around the cleaning and developing devices; and toner removing means, provided in the developing device, for removing the residual toners attached to the surface of the belt-shaped member in the interior of the cleaning device from the belt-shaped member in the interior of the developing device. However, the belt-shaped member disclosed in the image forming equipment does not deliver part of the surplus toners that have not been used for development in the developing device to the cleaning device. Also, in the subject publication (that is, Japanese Patent Publication No. 63-246780 of Showa), no teaching is disclosed regarding a toner supply means which is used to supply toners to the toner delivery path of the toner delivery device.

On the other hand, in the image forming equipment which uses toners to form an image on recording paper according to an electrophotographic method, it is necessary to provide a toner residual quantity detection device which detects the residual quantity of the toners because recording is impossible if the toners run out in the developing device.

In conventional image forming equipment, normally, for example, as disclosed in Japanese Patent Publication No. 4-97179 of Heisei, the toner residual quantity detection device is provided in the developing device.

However, when the toner residual quantity detection device is provided in the developing device as in the conventional image forming equipment, the developing device becomes inconveniently large.

Therefore, if this conventional technique is used in the image forming equipment developed by the present inventors, the resulting combination goes against the object of the image forming equipment (i.e., the miniaturization of the developing device) and is thus not desirable.

SUMMARY OF THE INVENTION

It is an object of the invention to solve the above-mentioned conventional problems and also, in the above-mentioned image forming equipment developed by the present inventors, to be able to detect precisely the residual quantity of the toners without incurring any increase in the size of the developing device.

In attaining the above and other objects, according to the invention, there is provided image forming equipment which comprises: a developing device, in contacts with a photosensitive member, supplying toners to the surface of a photosensitive member and developing a latent image on the surface of the photosensitive member, thereby forming a toner image; a cleaning device, that removes and collects the residual toners that are still attached to the photosensitive member surface after the toner image formed by the developing device is transferred to paper; a toner delivery device, interposed in a closed loop between the developing and cleaning devices, delivering a portion of surplus toners not used for development in the developing device to said cleaning device, and delivering the residual toners collected by the cleaning device to the developing device; toner supply means for supplying toners to a toner delivery path of the toner delivery device; and a detection device provided in the toner delivery path, detecting toner depletion. The detection device, preferably, may be disposed downstream of the developing device and upstream of the cleaning device. Also, the detection device, preferably, may include a detect window provided in the toner delivery path, and an optical sensor provided in the detect window. Preferably, the detect window may be floated electrically. At least the surface of the detect window that contacts the toners may be formed of a material that possesses the same polarity as an electrified polarity of the toners in a triboelectric series.

Also, the toner delivery device includes a toner delivery member movable circulatingly between the developing and cleaning devices, and the toner delivery member may be preferably arranged such that it moves in sliding contact with the detect window. It is also preferable that the toner delivery member may be floated electrically. Now, the detection device includes the detect window provided in the toner delivery passage, an elastic reflecting plate disposed to face the detect window, and a reflection type optical sensor provided in the detect window, while the reflecting plate may preferably energize the toner delivery member toward the detect window. Further, the toner delivery path includes a side wall surface which is capable of sliding contact with the toner delivery member to guide the toner delivery member and, preferably, at least the surface portion of the side wall surface situated in the neighborhood of the detect window may be so inclined as to form an acute angle with respect to the surface of the detect window facing the toner delivery passage. Moreover, preferably, the reflecting plate may be electrically floated. It is preferable, in some cases, that at least the surface of the reflecting plate that contacts the toners may be formed of a material that possesses the same polarity as an electrified polarity of the toners in a triboelectric series.

Also, according to the invention, there is provided image forming equipment which comprises: a developing device, in contacts with a photosensitive member, supplying toners to the surface of a photosensitive member and developing a latent image on the surface of the photosensitive member, thereby forming a toner image; a cleaning device, for removing and collecting the residual toners that are still attached to the surface of the photosensitive member after the toner image formed by the developing device is transferred to paper; a toner delivery device interposed in a closed loop between the developing and cleaning devices for delivering, to the cleaning device, part of the surplus toners that have not been used for development in the developing device, and for delivering, to the developing device, the residual toners collected by the cleaning device; a toner supply means for supplying toners to a toner delivery path of the toner delivery device; an elastic toner delivery member movable circulatingly within the toner delivery path of the toner delivery device; a transparent detect window provided in the toner delivery path and including a projecting surface projecting toward the elastic toner delivery member; and an optical sensor provided in the detect window. Preferably, the optical sensor may be disposed downstream of the developing device and upstream of the cleaning device. Also, it is preferable that the toner delivery means may be formed of a coil spring and the length of the projecting surface of the detect window in the toner delivery direction may be equal to or less than 2 pitches of the coil spring. Preferably, at least the projecting surface of the detect window may be formed of a material that possesses the same polarity as an electrified polarity of the toner in a triboelectric series, and the elastic toner delivery member may be floated electrically. It is also preferable that the optical sensor may comprise a reflection optical sensor, and that an elastic reflection plate may be disposed opposite the detect window with the toner delivery member between them, and the reflection plate may urge the toner delivery member toward the detection window. Preferably, the reflection plate may be electrically floated and, depending on the situation, at least the surface of the reflection plate that contacts the toners may be formed of a material that is possesses the same polarity as an electrified polarity of the toner in a triboelectric series. The toner delivery path includes a side wall surface which is capable of sliding contact with the toner delivery member for guiding the same and, preferably, at least the surface portion of the side wall surface existing in the neighborhood of the detect window may be so inclined as to form an acute angle between the projecting surface of the detect window and itself.

BRIEF DESCRIPTION OF THE DRAWINGS

FIG. 17(*b*) is a partially enlarged view of FIG. 17 (*a*);

DETAILED DESCRIPTION OF THE PREFERRED EMBODIMENT

Figure 1:
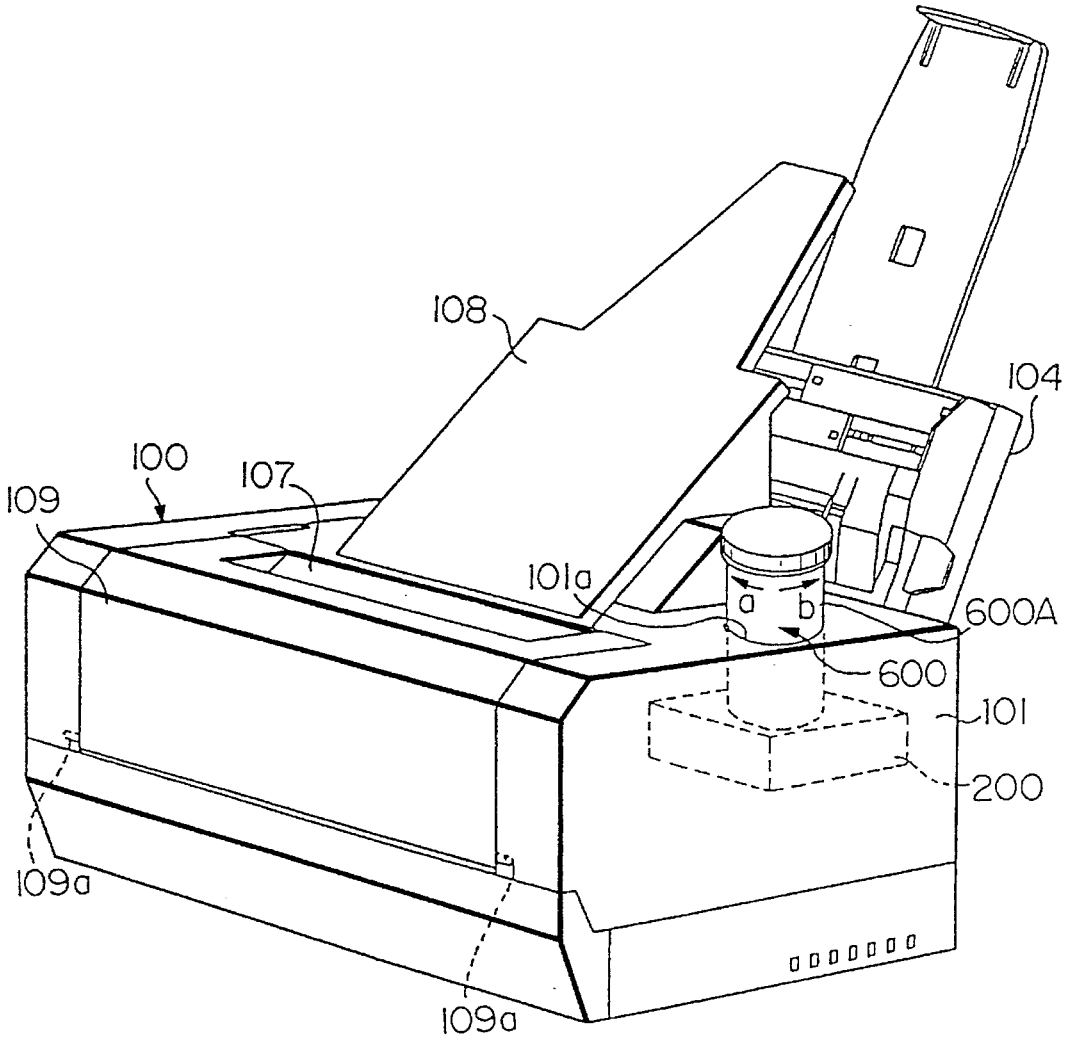
FIG. 1 is a perspective view of a printer using an embodiment of image forming equipment according to the invention.
Figure 2:
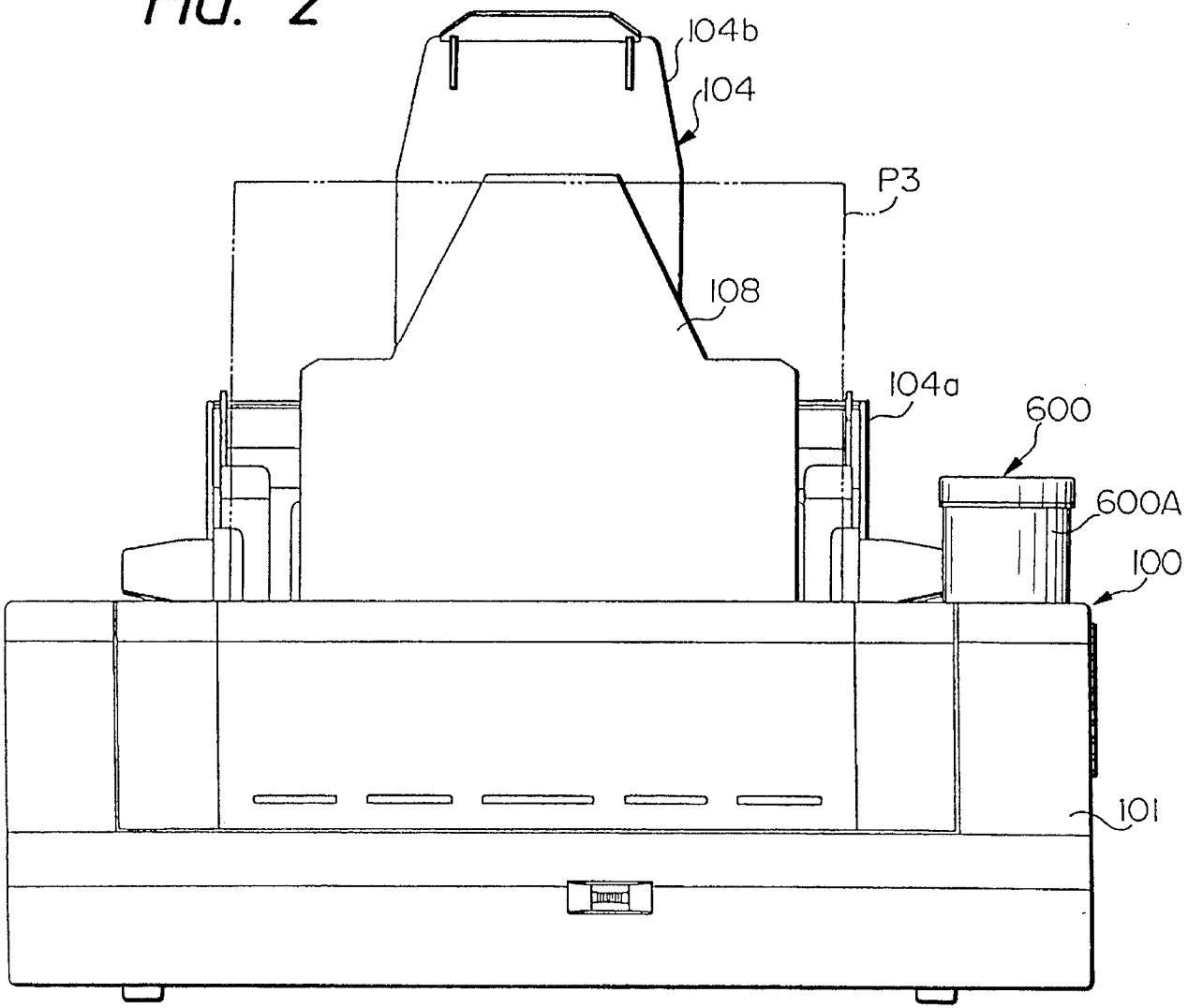
FIG. 2 is a front view of the above printer.

Description will now be given of the embodiments of image forming equipment according to the invention with reference to the accompanying drawings.

Referring to FIGS. 1–4, reference character 100 designates a printer main body and 101 stands for a case for the printer main body 100. Within the case 101, there are disposed a paper feed roller 102, an optical unit 110, an image forming unit 200, a fixing unit 120, and a paper discharge roller 103. For reference, in FIG. 1, the image forming unit is drawn in a general manner (that is, in a typical manner).

Numeral 600 designates a toner tank which serves as the toner supply means that replenishes toners to the image forming unit 200. The present image forming equipment comprises mainly the optical unit 110, image forming unit 200, and toner tank 600.

Figure 3:
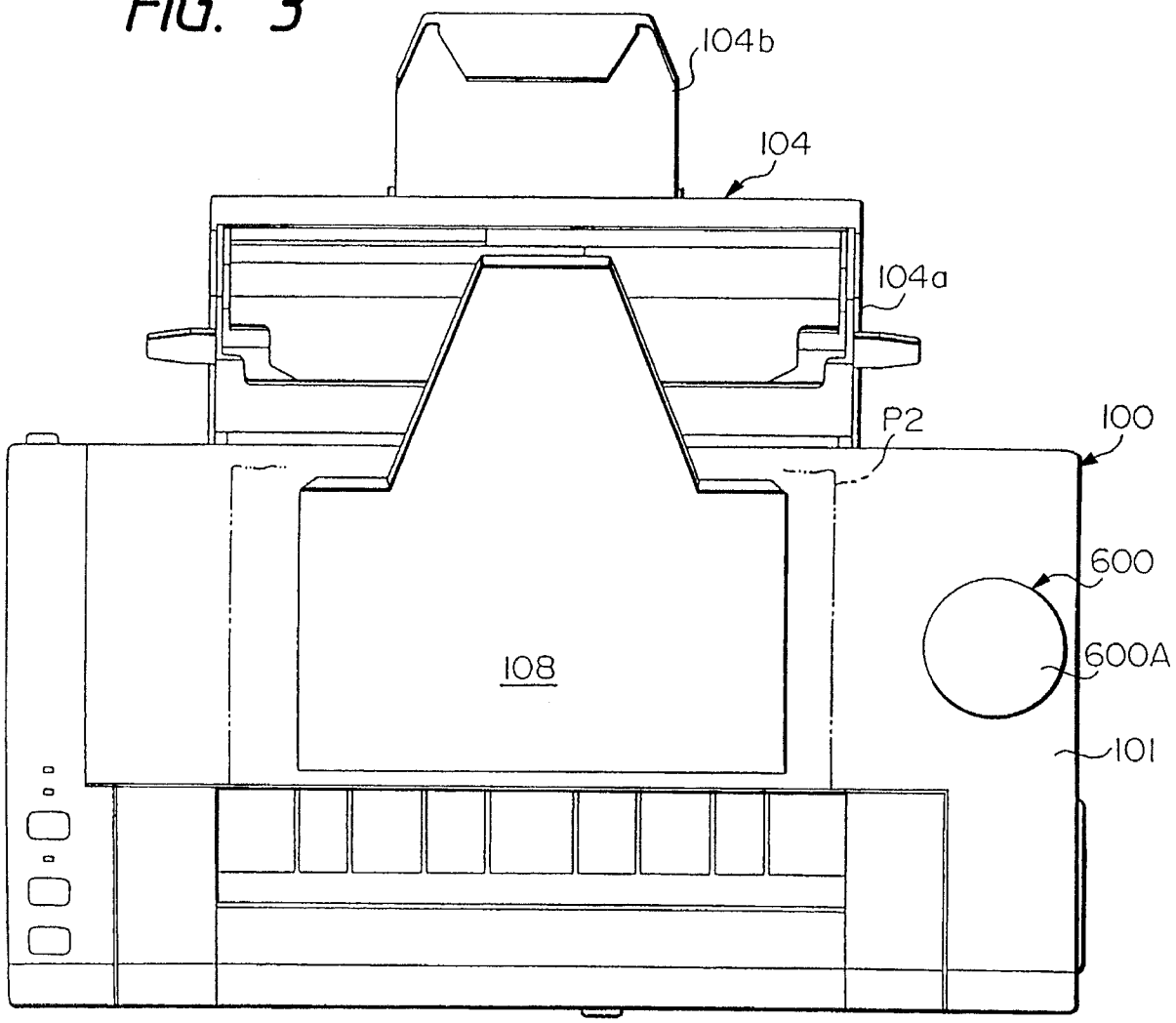
FIG. 3 is a plan view of the above printer.

The toner tank 600 is disposed such that, when it is mounted in the main body 100, the upper portion thereof is exposed externally of the case 101. In FIG. 3, P2 designates the recording paper that is being discharged onto a paper discharge tray 108, and in FIG. 2, P3 stands for the recording paper that has been discharged onto the paper discharge tray 108. As can be seen clearly from these figures, the exposed portion 600A of the toner tank 600 is exposed externally of the case 101, away from the moving path of the recording paper.

Description will now be given in detail of the main body 100, image forming unit 200, and toner tank 600. First, however, the whole structure of the main body 100 will be described.

In the back portion of the case 101, there is disposed a paper feed tray 104 such that it is rotatable. The paper feed tray 104 includes a base portion 104*a* supported rotatably by the back portion of the case 101 and a tray 104*b* so mounted as to be slidable with respect to the base portion 104*a*. While not in use, as shown by a broken line in FIG. 4, with the tray 104*b* stored in the base portion 104*a*, the paper feed tray 104 is folded so as to be in close contact with the back surface of the case 101. When in use, as shown by a solid line, the paper feed tray 104 is opened before it is used.

Two or more sheets of recording paper P that are set in the paper feed tray 104 are fed one by one by the paper feed roller 102.

The recording paper fed passes through a paper feed path A1 formed by a paper guide 105 and the lower surface of the image forming unit 200 and reaches between a photosensitive drum 201, in which a toner image is formed in a manner to be discussed later, and a transfer roller 106. Here, the recording paper with a toner image transferred from the photosensitive drum 201 passes through a path A2 between a fixing roller 121 and a pressure roller 122, which are respectively included in a fixing unit 120, thereby fixing the toner image. After then, the recording paper passes through an upwardly curved paper discharge path A3 and is discharged from a paper discharge opening 107 onto the paper discharge tray 108 by the paper discharge roller 103.

Numeral 109 designates a cover in which the above-mentioned paper discharge path A3 is formed, and the cover 109 is openable and closable with respect to the main body 100 by means of shafts 109*a*, 109*a*. The paper discharge opening 107 is formed on in the upper surface of the cover 109 and the fixing unit 120 is mounted on the cover 109. The cover 109 may be opened on this side when the paper clogging occurs or for maintenance.

Next, description will be given below of the image forming unit 200.

As shown in FIGS. 5–8, the image forming unit 200 is structured as a single unit by incorporating a photosensitive drum 201 used as a photosensitive member, an electrifying roller 202, a developing device 300, a cleaning device 400, a toner delivery device 500, and detection device 700 into a case 210.

The photosensitive drum 201 includes a conductive substrate formed of an aluminum drum and a photosensitive layer made of an organic photosensitive material and formed on the conductive substrate. The photosensitive drum 201 is supported rotatably and can be rotationally driven in a direction of an arrow a by a drive mechanism (not shown).

The electrifying roller 202 is pressed against the photosensitive drum 201 by a pressure mechanism (not shown) and can electrify the photosensitive drum 201 while it follows the photosensitive drum 201. A bias voltage is applied to the electrifying roller 202.

Figure 4:
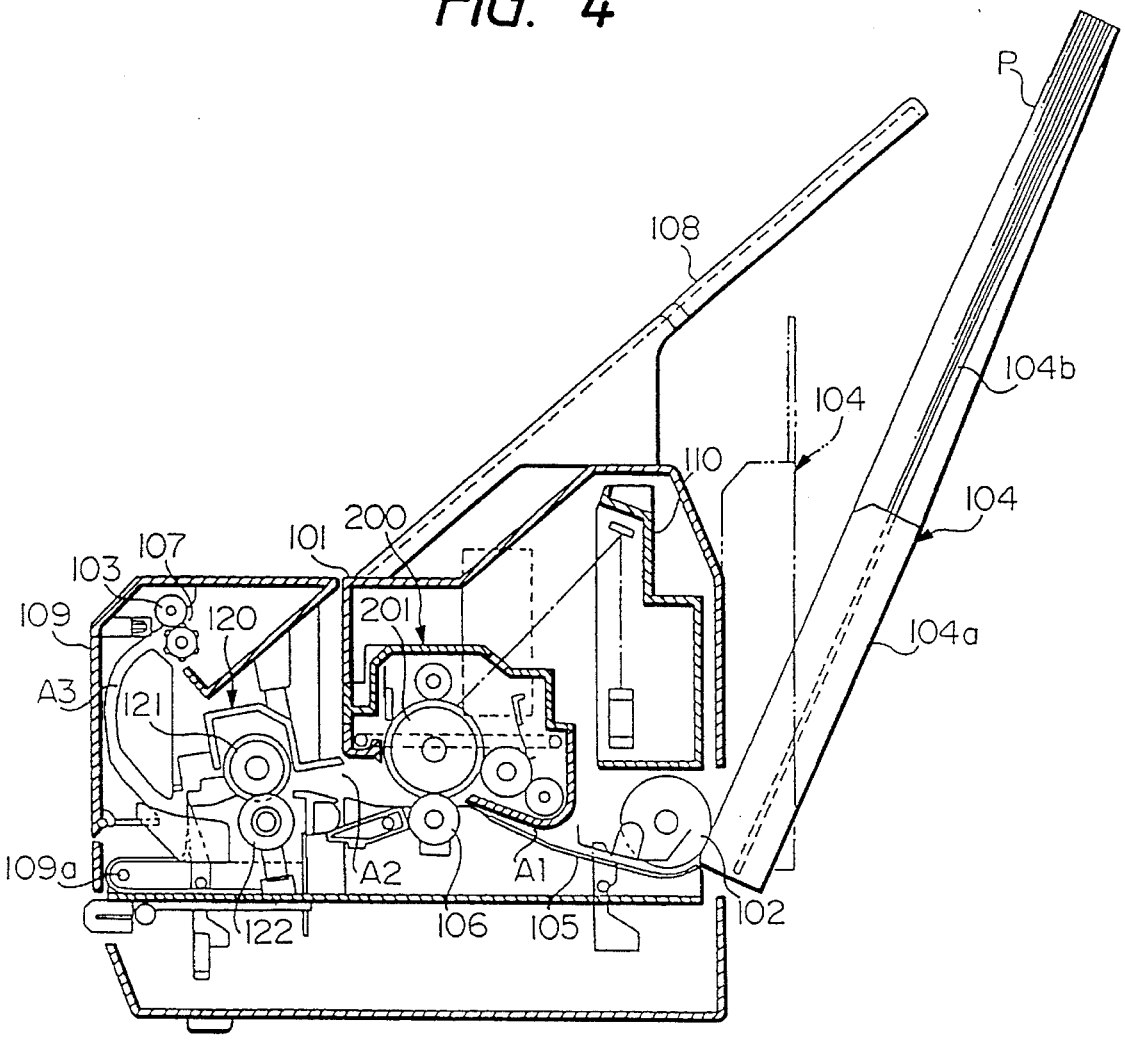
FIG. 4 is a section view of the above printer.
Figure 5:
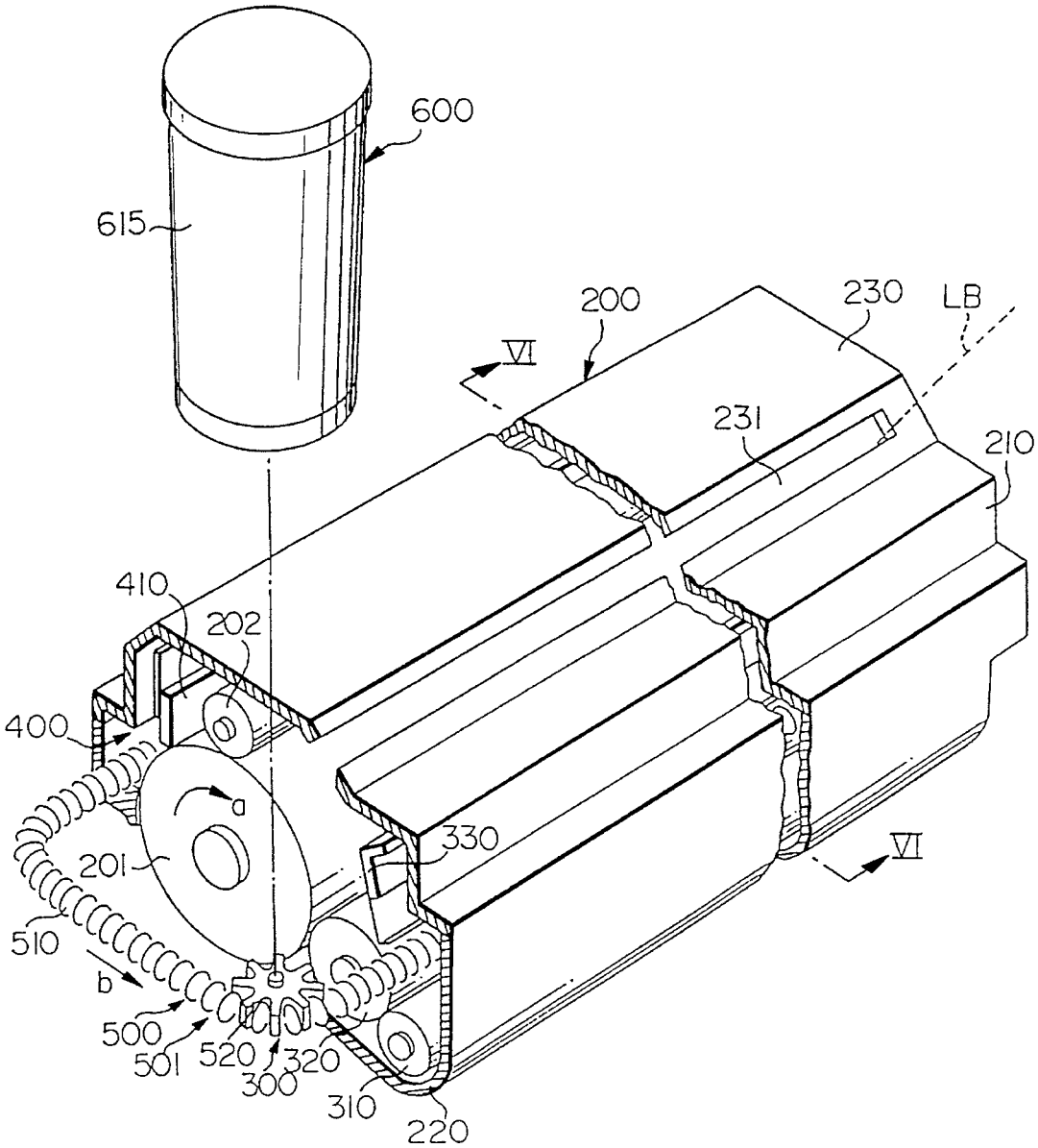
FIG. 5 is a partially omitted perspective view of an image forming unit and a toner tank respectively employed in the above printer.

The electrified photosensitive drum 201 is scanned by a laser beam LB radiated from the optical unit 110 shown in FIG. 4, whereby a latent image is formed on the surface of the photosensitive drum 201.

The case 210 consists of a lower case 220 and an upper case 230, while the upper case 230 includes a slit 231 for beam scanning.

The developing device 300 includes a toner storage chamber 301, defined by the lower case 220, so as to extend in the longitudinal direction of the lower case 220; a supply roller 310 disposed so as to be rotatable within the toner storage chamber 301; a developing roller 320 disposed similarly; and a regulation blade 330 in contact with the peripheral surface of the developing roller 320. The supply roller 310 and developing roller 320 can be rotationally driven respectively in directions of arrows shown in FIG. 6 by a drive mechanism in linking with the drive mechanism of the photosensitive drum 201. The regulation blade 330 is formed of an elastic member such as a stainless steel plate or the like and is mounted to the upper case 230 by a mounting member 331.

The supply roller 310 rotates while stirring the toners stored within the toner storage chamber 301, and coats the toners onto the surface of the developing roller 320. The toners that are coated on the surface of the developing roller 320 are brought into sliding contact with the regulation blade 330, so that they are turned into a thin layer and are also frictionally electrified. With the bias voltage being applied to the developing roller 320, the thin-layered toners are delivered to the photosensitive drum 201 and are invertingly developed on the latent image on the surface of the photosensitive drum 201 in a nip portion which consists of a pressure contact portion between the developing roller 320 and photosensitive drum 201. As a result of this, the latent image on the surface of the photosensitive drum 201 is developed to thereby form a toner image.

The toner image formed on the surface of the photosensitive drum 201 is then transferred to recording paper P which is being held between and delivered by the transfer roller 106 (see FIG. 4), to which a bias voltage having a reversed polarity to the toner image is being applied, and the photosensitive drum 201.

The cleaning device 400 includes a cleaning blade 410, which is mounted to the upper case 230 by a mounting member 420. The cleaning blade 410 includes a lower edge 411 which is in contact with the peripheral surface of the photosensitive drum 201. Thus, the lower edge 411, after the toner image is transferred to the recording paper, scrapes the residual toners adhered to the surface of the photosensitive drum 201 toward a toner collect portion 560 in the toner delivery device 500.

After the residual toners are scraped off and thus the photosensitive drum 201 is cleaned, the photosensitive drum 201 is moved again to the above-mentioned image forming process.

The toner delivery device 500 is disposed in a closed loop between the developing device 300 and cleaning device 400, and includes a coil spring 510 serving as toner delivery means, a drive gear 520 engageable with the coil spring 510 to drive the same circulatingly, and a guide portion 530 (see FIG. 8) formed in a substantially groove-like shape and capable of sliding contact with the coil spring 510 for guiding the same.

The coil spring 510 is structured in an endless shape and is so disposed as to be movable in circulating manner between the inside of the cleaning device 400 and the inside of the developing device 300.

The drive gear 520 can be driven by a drive mechanism (not shown) linked with the drive mechanism of the photosensitive drum 201 to drive the coil spring 510 circulatingly in a direction of an arrow b in FIGS. 5–8.

Figure 8:
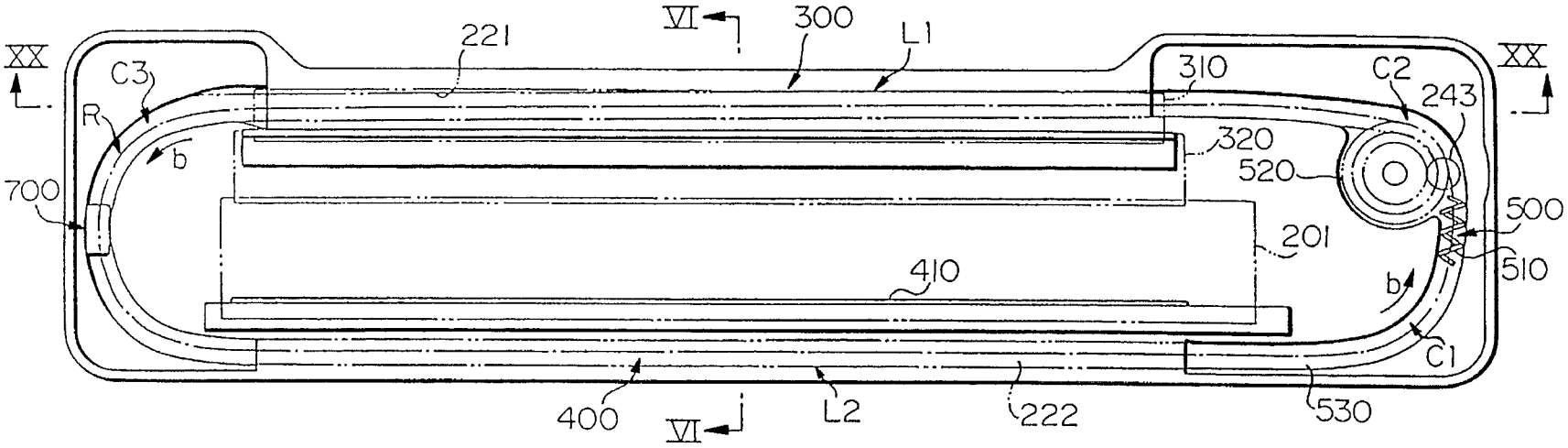
FIG. 8 is a typical plan view of the whole image forming unit.

Now, FIG. 8 is a typical plan view of the whole of the image forming unit 200.

As can be seen clearly from FIG. 8, the guide portion 530 is structured in a shape which can reform the shape of the coil spring 510, which would make a circle in its natural condition, into an almost elliptic shape when viewed in a plan view before it guides the coil spring 510. In particular, the guide portion 530 includes two corner portions C1, C2 which are respectively formed in an almost ¼ arc shape, a corner portion C3 formed in a hemi-arc shape, and two substantially linear portions L1, L2 which connect these corner portions with one another.

Figure 6:
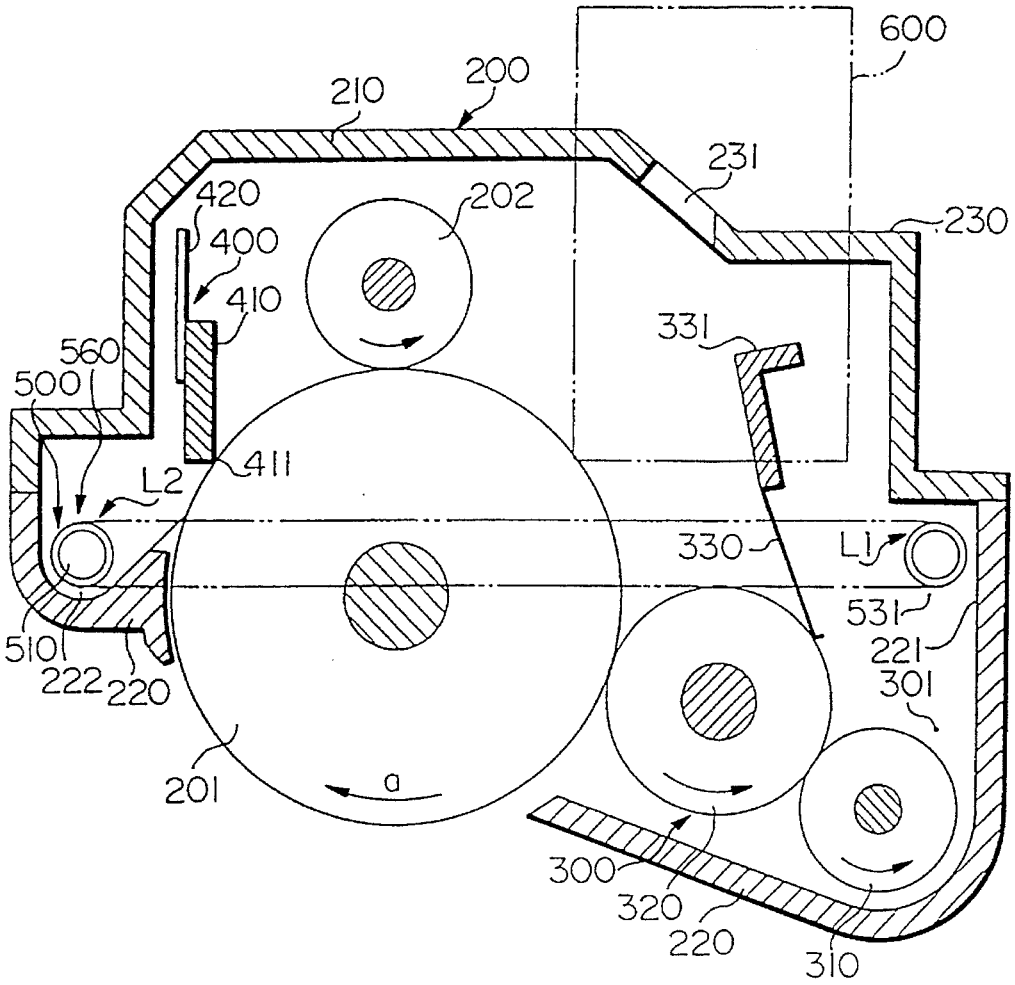
FIG. 6 is a section view taken along the line VI—VI in FIG. 5.

One linear portion L1 of the two linear portions L1, L2, as shown in FIG. 6, exists within the developing device 300, while the other linear portion L2 exists in the cleaning device 400. And for the one linear portion L1, a guide portion is defined by a standup wall 221 provided in the lower case 220 and, for the other linear portion L2, a guide portion is defined by a recessed groove 222 formed in the upper portion of the lower case 220. Also, the linear portion L1 existing within the developing device 300 is so structured as to guide only the outside of the coil spring 510 by means of the standup wall 221, with the result that there is formed an opening portion 531 used to open the lower portion of the coil spring 510 with respect to the developing device 300.

That is, within the developing device 300, only the outside of the coil spring 510 is guided by the standup wall 221 to thereby be able to release the toners into the developing device 300. On the other hand, in the toner collect portion 560 within the cleaning device 400, the upper portion of the coil spring 510 is opened toward the cleaning blade 410 in order to be able to receive and collect the toners that are scraped off by the cleaning blade 410.

The thus structured image forming unit 200 operates in the following manner.

As described before, the toners are supplied to the surface of the photosensitive drum 201 by the developing device 300 and the latent image on the surface of the photosensitive drum 201 is developed by the toners, thereby forming the toner image. After the toner image is transferred to the recording paper P, the residual toners adhered to the surface of the photosensitive drum 201 are removed by the cleaning blade 410 of the cleaning device 400 and are then collected into the collect portion 560 provided in the cleaning device 400.

Between the cleaning device 400 and developing device 300, there is provided the endless coil spring 510 such that it can circulate between the inside of the cleaning device and the inside of the developing device. Since the coil spring 510 is circulatingly driven by the drive gear 520, part of the surplus toners, which are stored in the toner storage chamber 301 of the developing device 300 and have not been used for development, are delivered to the cleaning device 400 by the coil spring 510, while the residual toners collected into the cleaning device 400 are stirred and mixed with the surplus toners and are then delivered to the developing device 300.

The toners delivered to the developing device 300 are released toward the toner storage chamber 301 if the toners within the toner storage chamber 301 have been consumed and the level surface thereof is lowered.

By repeating the above-mentioned operation, the toners within the image forming unit 200 are consumed gradually, while a quantity of toners corresponding to the quantity of the toners consumed are replenished from the toner tank 600 as occasion demands.

Figure 14:
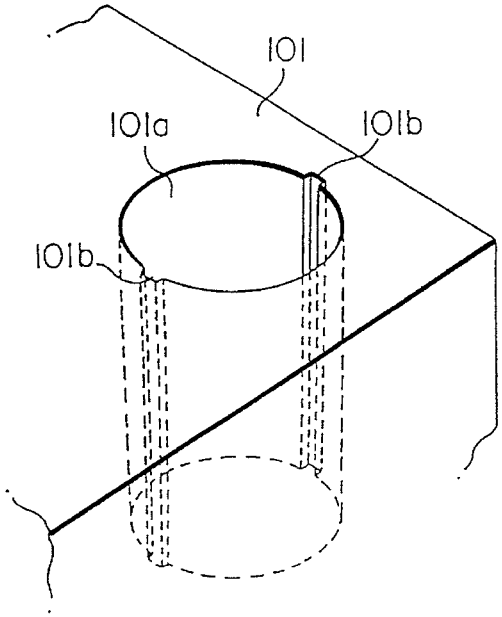
FIG. 14 is a partially perspective view of a case for a printer main body.

As shown in FIGS. 1 and 14, in the upper surface of the case 10 of the printer main body, there is opened up a toner tank mounting hole 101*a* through which the toner tank 600 can be removably mounted to the upper case 230 of the image forming unit 200. In the inner wall surface of the mounting hole 101*a*, there is formed a guide groove 101*b* used to guide a projected portion 616 (see FIG. 9) which is provided in the toner tank 600 to be discussed below.

Figure 9:
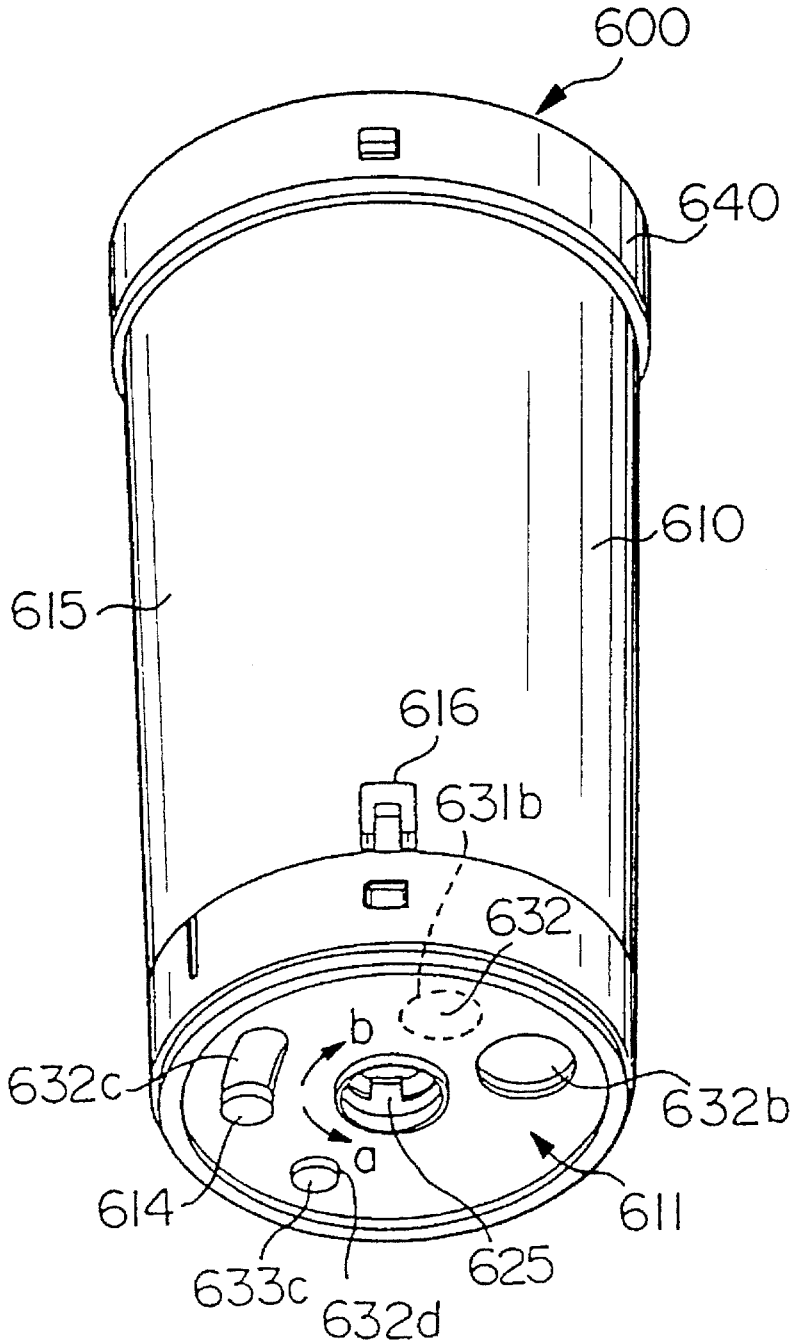
FIG. 9 is a perspective view of the toner hank when viewed from below.
Figure 10:
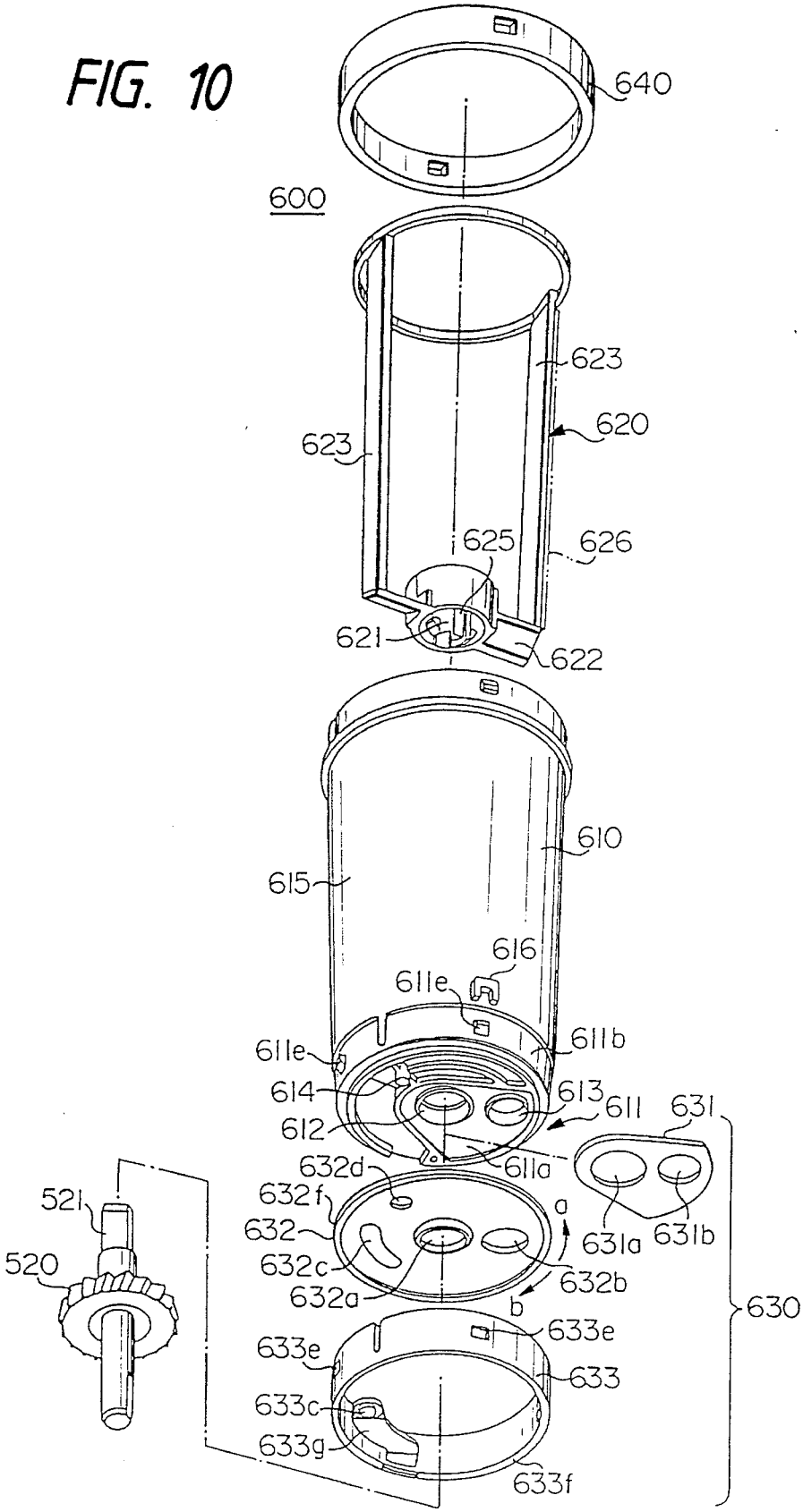
FIG. 10 is an exploded perspective view of the toner tank.

Next, description will be given below of the structure of the toner tank 600 with reference to FIGS. 9 and 10.

The toner tank 600 includes a transparent tank case 610 into which toners are loaded, an agitator 620 disposed within the tank case 610 such that it is rotatable, a shutter portion 630 provided in the bottom portion of the tank case 610, and a cover 640.

In the bottom portion 611 of the tank case 610, there are provided an axial hole 612, a toner supply port 613, and a pin 614. Also, on the outer peripheral surface 615 of the tank case 610, there are provided a pair of projected portions 616 which are removably engageable with a pair of dovetail grooves (L-shaped grooves) 242, 242 formed in a recessed portion 240 (see FIG. 12) in the upper case 230 to be discussed later.

The agitator 620 includes a shaft portion 621, a scrape-up blade 622 used to scrape up the toners in the tank case 610, and a stir blade 623 formed integrally with the scrape-up blade 622 for stirring the toners in the tank case 610. And the shaft portion 621 is rotatably mounted to the axial hole 612 in the tank case bottom portion through a seal ring (not shown). In the shaft portion 621, there is formed a groove 625 which is engageable with a shaft 521 provided in the drive gear 520, when the toner tank 600 is mounted to the upper case 230 of the image forming unit in a manner to be discussed later. Also, in the stir blade 623, as shown by an imaginary line, there can be provided integrally a wiper-like cleaning member 626 which is formed of rubber or the like for cleaning the inner wall surface of the tank case 610.

The shutter portion 630 includes a seal member 631 formed of an elastic material such as a sponge or the like, a disk-shaped shutter 632, and a guide member 633.

The seal member 631 is formed in a fan shape and can be fitted into a recessed portion 611*a* which is formed in the tank case bottom portion 611 and is identical in shape with the seal member 631. The seal member 631 includes an axial hole 631*a* which, when the seal member 631 is fitted into the recessed portion 611*a*, coincides with the axial hole 612 in the tank case bottom portion, and a toner supply port 631*b* which coincides with the toner supply port 613 in the above-mentioned fitted condition.

The shutter 632 includes an axial hole 632*a* to be coincident with the axial hole 612 in the tank case bottom portion 611, a toner supply port 632*b* to be coincident with the toner supply port 613, an arc-shaped elongated 632*c* into which the pin 614 of the tank case bottom portion can be inserted, and an engaging hole 632*d* engageable with a pin 244 provided in the upper case 230 of the image forming unit which will be discussed later.

The guide member 633 is formed in a ring shape as a whole and is mounted on a stepped portion 611*b* which is provided in the tank case bottom portion 611. When it is mounted, the four square holes 633*e* of the guide member 633 are respectively engaged with four engaging claws 611e provided in the stepped portion 611*b* and thus the guide member 633 is fixed to the tank case bottom portion 611, while the inner surface (upper surface) of the bottom edge portion 633*f* thereof supports the peripheral edge portion 632*f* of the shutter 632 in a slidingly rotatable manner. Also, the guide member 633 includes an elastic arc-shaped tongue piece 633*g* formed integrally therewith and, in the leading end portion of the tongue piece 633*g*, there is provided a projection 633*c* which can be loosely fitted from the back surface thereof (the upper surface side in FIG. 10) into the engaging hole 632*d* of the shutter 632 (see FIG. 13). The shutter 632 is mounted to the guide member 633 from the upper surface side of the guide member 633 by inserting the shutter 632 under the tongue piece 633*g*. The engagement of the projection 633*c* into the engaging hole 632*d* prevents the inadvertent rotation of the shutter 632 and coincides the toner supply port 632*b* with the toner supply port 613 of the tank case bottom portion to thereby prevent the leakage of the toners existing within the toner tank case 610.

Figure 13:
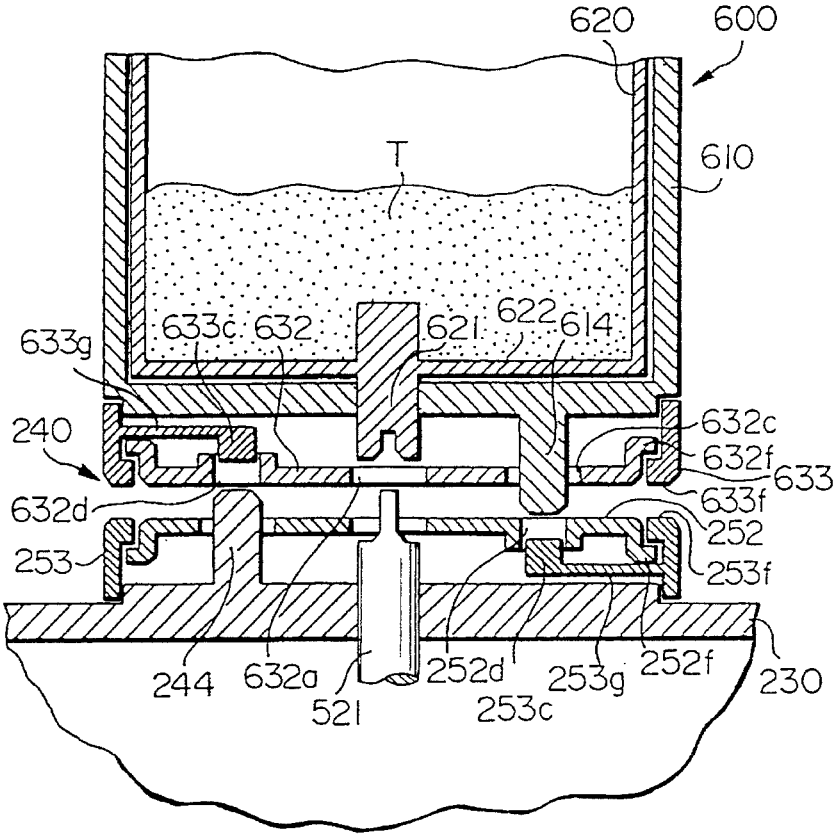
FIG. 13 is a typical section view showing a state just before the toner tank is mounted to the mounting portion of the image forming unit.

In the toner tank 600 structured in the above manner, when the respective parts thereof are assembled together, the pin 614 in the tank case bottom portion extends through the elongated hole 632*c* of the shutter 632 and the leading end of the pin 614 projects out from the elongated hole 632*c* (see FIG. 13). The seal member 631 is bonded to the tank case bottom portion 611 in such a manner that the toner supply port 631*b* thereof is coincident with the toner supply port 613 of the tank case bottom portion 611, and is held while it is pressed by the shutter 632. This improves the close adherence between the seal member 613 and shutter 632 to thereby be able to prevent the leakage of the toners. The shutter 632 is held between the tank case bottom portion 611 and guide member 633 in such a manner that it can be rotated and slid in a direction of an arrow a or b in FIG. 10 in such a range as the pin 614 can move relatively along the elongated hole 632*c*. That is, in the shutter portion 630, only the shutter 632 can rotate and slide relatively with respect to the tank case 610. When the toner tank 600 is not mounted to the image forming unit, the toner supply port 632*b* of the shutter 632 is not coincident with the toner supply port 631*b* of the seal member 631. That is, the toner supply port 631*b* of the seal member 631 is sealed by the shutter 632.

Figure 11:
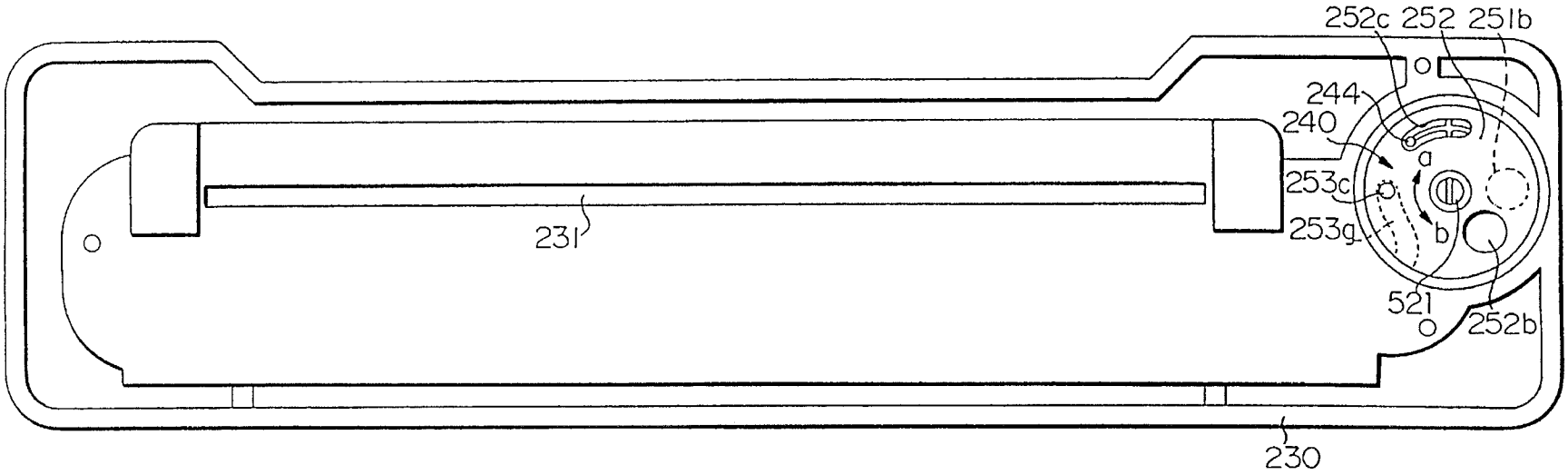
FIG. 11 is a plan view of the image forming unit.
Figure 12:
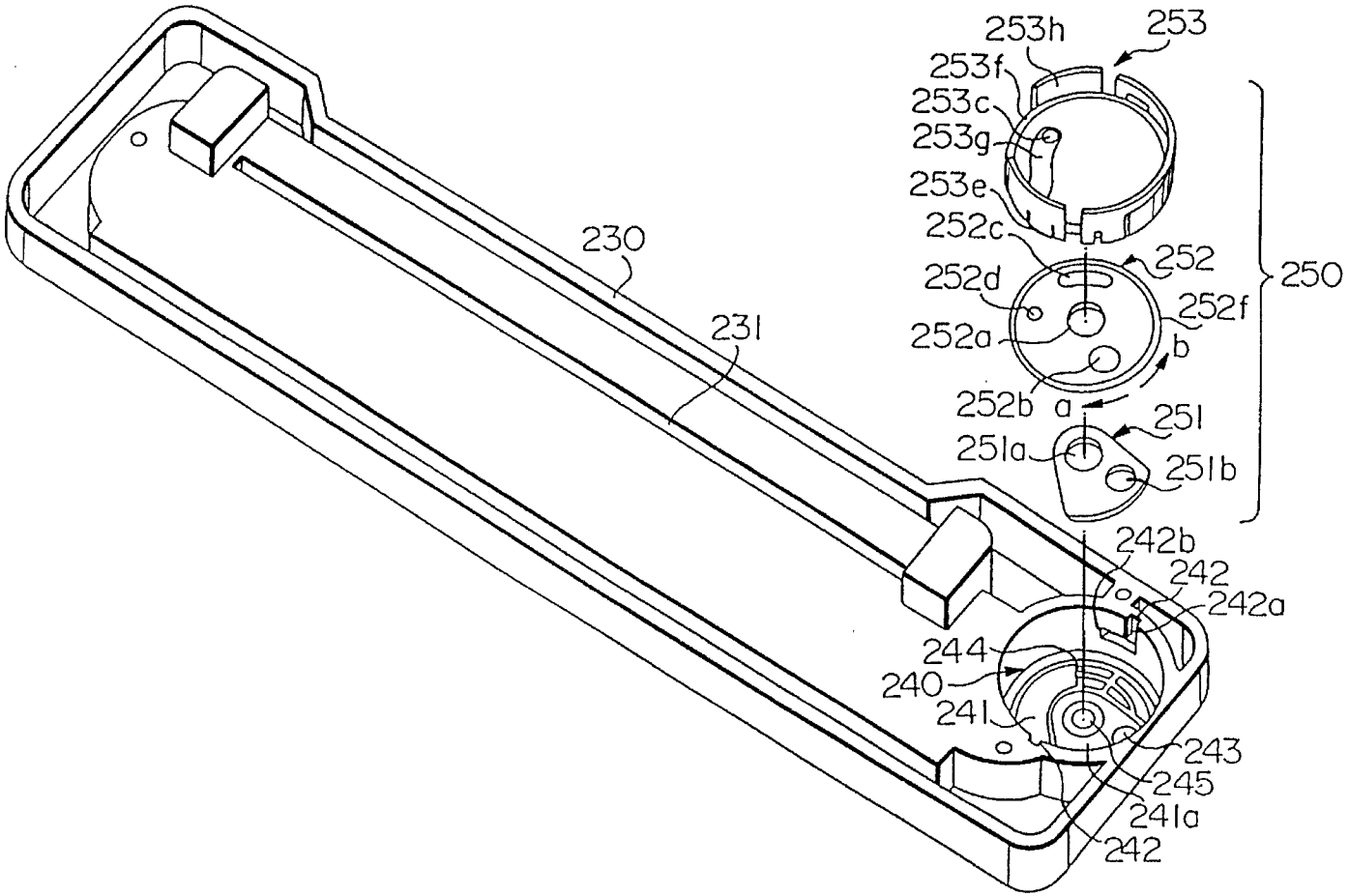
FIG. 12 is an exploded perspective view of the toner tank mounting portion of the image forming unit.

Next, description will be given below of the mounting portion 240 of the toner tank 600 in the upper case 230 of the image forming unit with reference to FIGS. 11 and 12.

The mounting portion 240 is structured as a recessed portion in which the respective parts of the lower portion of the toner tank 600 are fitted with one another. That is, the shutter portion 250, the structure of which is basically the same as that of the above-mentioned shutter portion 630 of the toner tank 600, is incorporated into the recessed portion.

In the bottom surface 241 of the recessed portion, there are disposed an axial hole 245 into which the shaft 521 of the drive gear is inserted, a toner supply port 243 (see FIG. 8) facing a portion at which the drive gear 520 and coil spring 510 in the above-mentioned circulation path of the coil spring 510 begin to mesh with each other, and a pin 244. Also, in the inner peripheral surface of the recessed portion, there are formed a pair of dovetail grooves (L-shaped grooves) 242, 242 which can be removably engaged with the above-mentioned projected portions 616 of the toner tank. Each dovetail groove 242 includes a vertical groove 242*a* and a horizontal groove 242*b*, while the upper end of the vertical groove 242*a* is connected with the lower end of a guide groove 101*b* formed in a mounting hole 101*a* (see FIG. 14) in the above-mentioned printer main body. Also, the terminal end of the horizontal groove 242*b* forms a regulation portion which regulates the terminal end of the rotational operation of the toner tank 600 in the toner tank mounting operation which will be discussed later.

The shutter portion 250 includes a seal member 251 formed of an elastic member such as a sponge or the like, a disk-shaped shutter 252, and a guide member 253.

The seal member 251 can be fitted into and bonded to a recessed portion 241*a* which is formed in the bottom surface 241 of the recessed portion and is identical in shape with the seal member 251. The seal member 251 includes a toner supply port 251*a* and a toner supply port 251*b*, which can be respectively coincident with the shaft hole 245 and toner supply port 243 when the seal member 251 is fitted into the recessed portion 241*a*.

The shutter 252 includes a shaft hole 252*a* to be coincident with the shaft hole 245, a toner supply port 252*b* which can be coincident with the toner supply port 243, an arc-shaped elongated hole 252*c* into which the pin 244 is inserted, and an engaging hole 252*d* engageable with the pin 614 of the toner tank 600.

The guide member 253 has a substantially ring-like shape and is to be mounted in the recessed portion (240). When the guide member 253 is mounted, the two engaging claws 253*e* thereof are respectively engaged into engaging holes (not shown) formed in the wall surfaces of the recessed portion, whereby the guide member 253 can be fixed in the recessed portion while the lower surface of the bottom edge portion 253*f* thereof supports the peripheral edge portion 252*f* of the shutter 252 (see FIG. 13). The guide member 253 includes an elastic arc-shaped tongue piece 253*g* provided integrally therewith and, in the leading end portion of the tongue piece 253*g*, there is provided a projection 253*c* (see FIG. 13) which can be loosely fitted into the engaging hole 252*d* from the back surface side (in FIG. 10, the lower surface side) thereof. The shutter 252 is so guided as to pass above the tongue piece 253*g* from the lower surface side of the guide member 253 and is inserted below the guide member 253. Engagement of the projection 253*c* into engaging hole 252*d* prevents the shutter 252 from rotating inadvertently, for example, when the printer main body is in transit, while coincidence of the toner supply port 252*b* with the toner supply port 243 prevents the leakage of the toner used in the image forming unit 200.

When the image forming unit 200 is assembled, the pin 244 on the bottom surface of the recessed portion extends through the elongated hole 252*c* of the shutter 252 and the leading end portion thereof projects out from the elongated hole 252*c* (see FIG. 13). Also, the seal member 251 is held while it is pressed by and between the bottom surface 241 of the recessed portion and the shutter 252. This improves the close contact between the seal member 251 and shutter 252 to thereby be able to prevent the leakage of the toners. The shutter 252 is held between the bottom surface 241 of the recessed portion and guide member 253 such that it is rotatable in a direction of an arrow a or b shown in FIGS. 11 and 12 within such a range that the pin 244 can move relatively with respect to and along the elongated hole 252*c*. That is, in the shutter portion 250, only the shutter 252 is allowed to rotate and slide relatively with respect to the upper case 230. Also, when the toner tank 600 is not mounted, the toner supply port 252*b* of the shutter 252, as shown in FIG. 11, is not coincident with the toner supply port 251*b* of the seal member 251. That is, the toner supply port 251*b* of the seal member 251 is sealed by the shutter 251.

Now, the mounting and removing operations of the toner tank 600 with respect to the above structured mounting portion 240 are as follows. Here, FIG. 13 is a typical section view of the toner tank 600 and mounting portion 240, showing a state just before the toner tank 600 is mounted to the mounting portion 240. Description will be given below of the mounting and removing operations and the operation of the toner tank 600 mainly with reference to FIG. 13.

At first, the toner tank 600 is inserted into the mounting hole 101*a* (see FIG. 14) of the main body case in such a manner that the projected portions 616 of the toner tank 600 are coincident with guide grooves 101*b* formed in the mounting hole 101*a*. If inserted, the projections 616 are guided by the guide grooves 101*b* such that they move downwardly within the guide grooves 101*b*, further advance into the vertical grooves 242*a* of the dovetail grooves formed in the mounting portion 240 of the image forming unit, and reach the lower ends of the vertical grooves 242*a* and stop there (FIG. 3 shows a state just before the projections 616 reach the lower end of the vertical groove 242*a*). At that time, the shaft 521 of the gear 520 is connected with the shaft portion 621 of the agitator 620 of the toner tank 600. Also, the pin 614 of the toner tank 600 is fitted into the engaging hole 252*d* of the shutter 252 provided in the mounting portion 240 of the image forming unit to press down the projection 253*c* of the tongue piece 253*g* to thereby remove the locking of the shutter 252 by the projection 253*c*. At the same time, the pin 244 provided on the mounting portion 240 side is fitted into the engaging hole 632*d* of the shutter 632 to press up the projection 633*c* of the tongue piece to thereby remove the locking of the shutter 632 by the projection 633*c*.

Next, the toner tank 600 is rotated counterclockwise, that is, in a direction of an arrow b shown in FIG. 1. Responsive to this, the projected portions 616 of the toner tank 600 are respectively allowed to enter the horizontal grooves 242*b* of the dovetail grooves and get engaged with them to thereby prevent the slippage of the toner tank 600. That is, the toner tank 600 is now mounted in the mounting portion 240. As described above, the pin 614 of the toner tank is fitted into the engaging hole 252*d* of the shutter 252 of the mounting portion 240, and the pin 244 provided on the mounting portion 240 side is fitted into the engaging hole 632*d* of the shutter 632 of the toner tank. Because of this, if the toner tank 600 is rotated in the direction of the arrow b shown in FIG. 1, then the shutter 252 of the mounting portion 240 is rotated together with the toner tank 600 in the same direction, that is, in the direction of the arrow b shown in FIG. 11, namely, counterclockwise so that the toner supply port 252*b* of the shutter 252 coincides with the toner supply port 251*b* of the seal member 251. On the other hand, the shutter 632 of the toner tank 600 does not move even if the toner tank 600 is rotated in the arrow b direction and, therefore, the shutter 632 moves clockwise as shown by an arrow a in FIG. 9 relatively with respect to the toner tank 600, so that the toner supply port 632*b* coincides with the toner supply port 631*b* of the seal member 631. In other words, the toner supply ports 613, 631*b*, 632*b*, 252*b*, 251*b*, and 243 of all parts are all coincident with one another, which allows the toner to be supplied from the toner tank 600 to the image forming unit 200.

In a state that the toner tank 600 is mounted to the image forming unit 200 in the above-mentioned manner, if the image forming unit 200 is operated in the above manner, then the agitator 620 is rotationally driven by the shaft 521 of the drive gear 520.

While the toners stored in the tank case 610 are stirred upwardly by the scrape-up blade 622 of the agitator 620, if the toners in the image forming unit 200 are consumed, then the toners stored in the tank case 610 drop freely by a quantity corresponding to the quantity of the toners consumed from the toner supply port 613 into the image forming unit 200 through the above-mentioned respective toner supply ports and the toner supply port 243 of the upper case 230, so that the toners can be replenished into the image forming unit 200.

Figure 7:
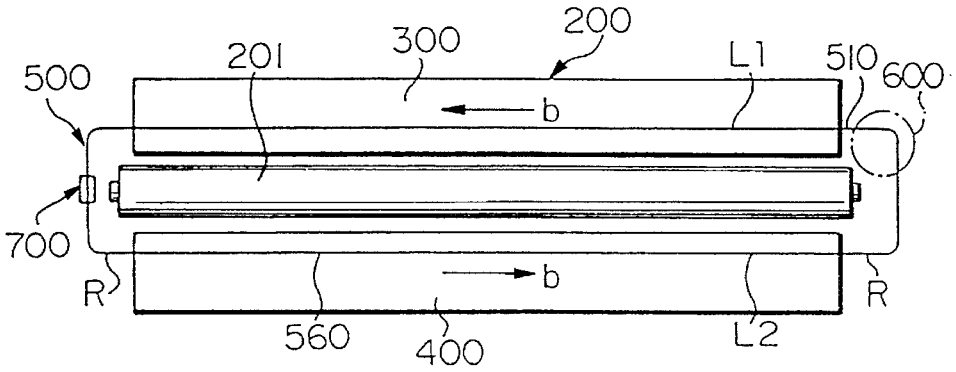
FIG. 7 is a typical plan view of the image forming unit and toner tank.

The toner tank 600, as shown in FIG. 7, is mounted upstream of the developing device 300. As shown in FIG. 8, since the toner supply port 243 is so opened as to face a position at which the drive gear 520 and coil spring 510 start to mesh with each other, there is eliminated the possibility that the toners can be supplied excessively to the toner delivery path C, and the toners can be supplied in a proper quantity.

When the toners are supplied or replenished from the toner tank 600 to the image forming unit 200 until the toner tank is empty, and no toners are replenished to the image forming unit 200, then the quantity of the toners in the image forming unit 200 decreases and the decrease in the toner quantity is detected by detection device 700 and, in accordance with the detection by the detection device 700, the toner tank is replaced. Here, because the tank case 610 is formed transparent, the fact that no toners are left in the toner tank can also be confirmed visually.

To remove the toner tank 600, the above-mentioned mounting operation may be performed reversedly. In other words, the upper portion (the exposed portion 600A that is exposed out of the main body case 101) of the toner tank 600 is gripped and the toner tank 600 is rotated in the arrow a direction (clockwise) and, after then, the toner tank 600 may be drawn out from the mounting hole 101*a* of the main body case 101. When the toner tank 600 is rotated in the arrow a direction, then the shutter 632 of the toner tank 600 is relatively rotated counterclockwise, namely, in the direction of the arrow b shown in FIG. 9. This motion covers the toner supply ports 613 and 631*b* of the toner tank 600. At the same time, the shutter 250 of the image forming unit 200 is rotated in the direction of the arrow a shown in FIG. 11, thereby shutting or covering the toner supply ports 243 and 252*b* of the image forming unit 200. Therefore, when removing the toner tank 600, even if some quantity of toners are left in the toner tank 600, there is eliminated the possibility that such toners can be scattered to contaminate the printer and its peripheries. Also, for example, when transporting the printer, even if the printer is transported with the toner tank 600 removed therefrom, there is no possibility that the toners remaining in the image forming unit 200 can leak from the toner supply ports 243 and 252*b* of the image forming unit 200 and can be scattered around.

Next, description will be given of the detection device 700.

The detection device 700, as shown in FIGS. 7 and 8, is disposed in the toner delivery path R, downstream of the developing device 300 and upstream of the cleaning device 400.

Figure 15:
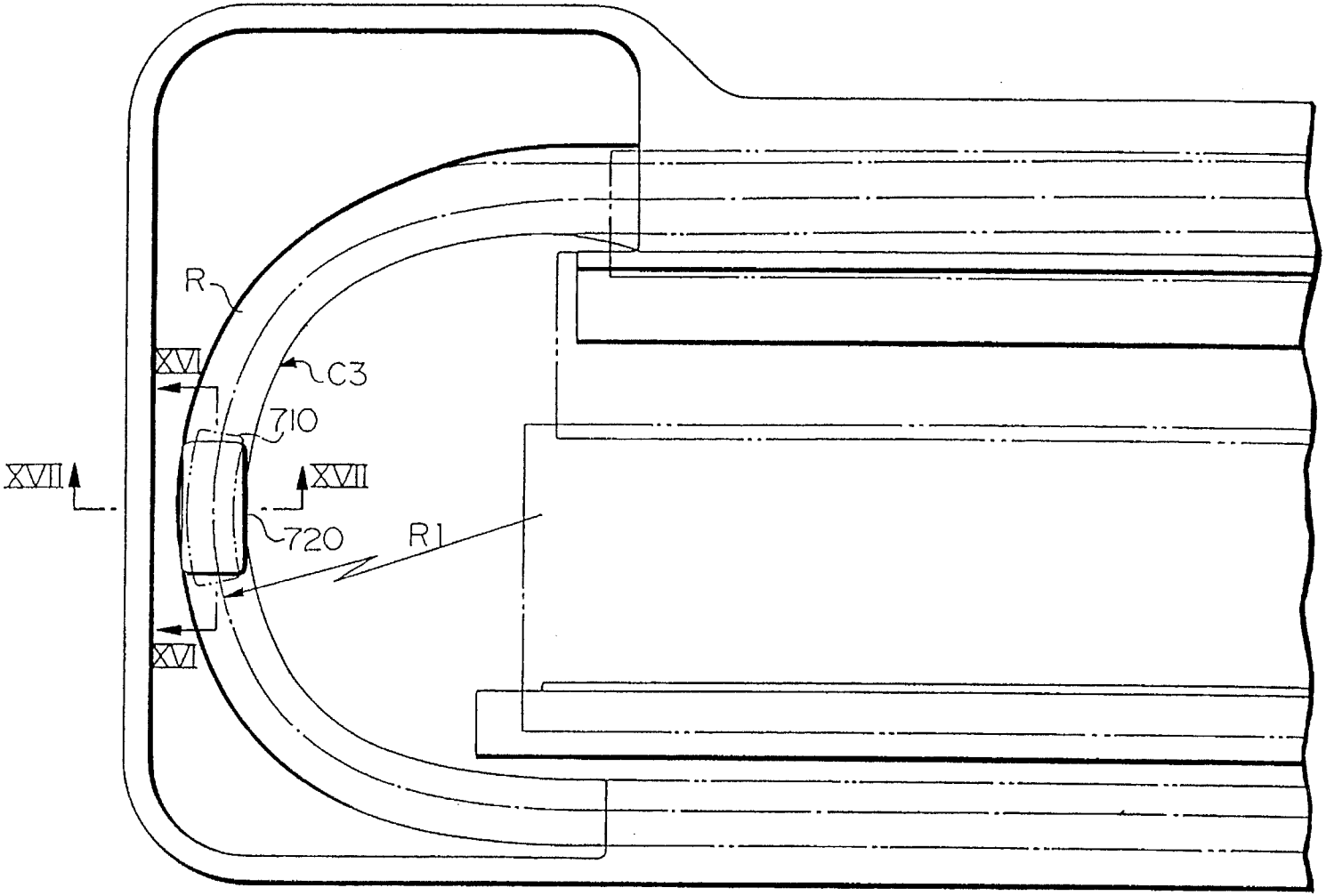
FIG. 15 is a partially enlarged view of FIG. 8.
Figure 16:
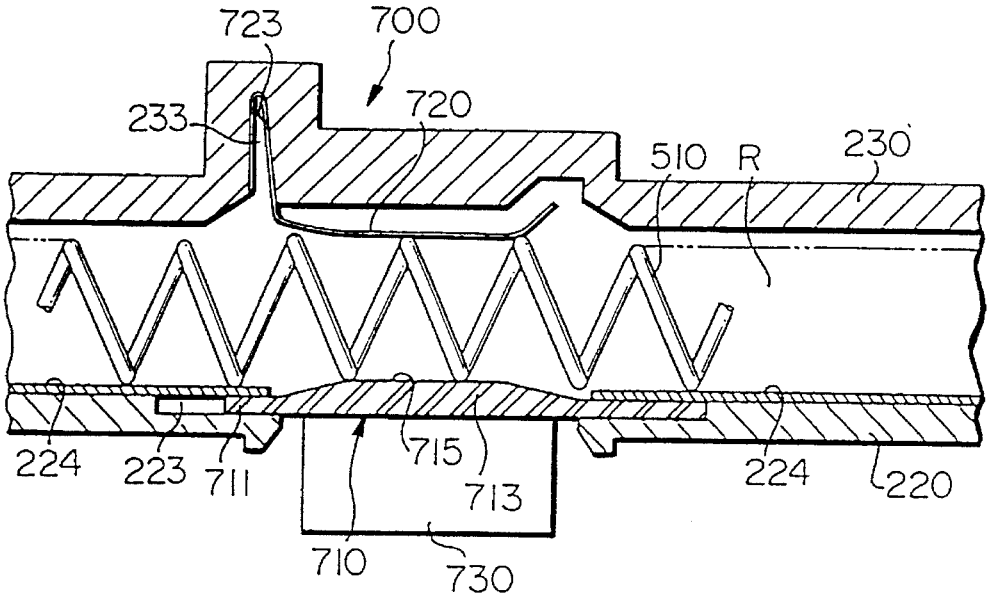
FIG. 16 is a section view taken along the line XVI—XVI in FIG. 15.
Figure 17A:
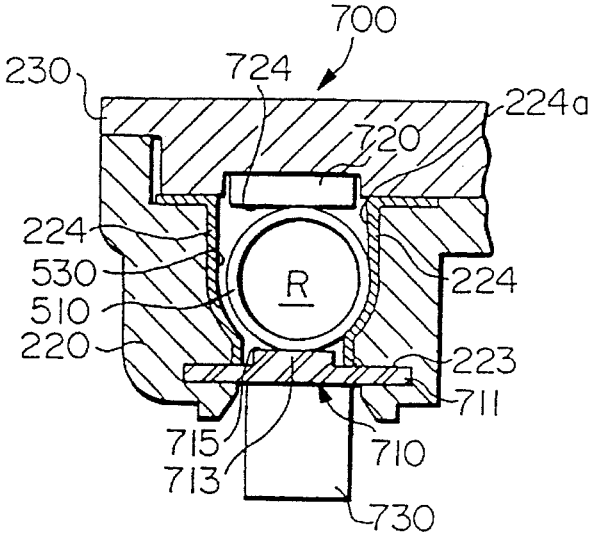
FIG. 17(*a*) is a section view taken along the line XVII—XVII in FIG. 15.
Figure 17B:
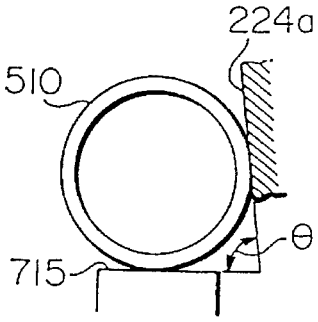

FIG. 15 is a partially enlarged view of FIG. 8, FIG. 16 is a section view taken along the line XVI—XVI shown in FIG. 15, and FIG. 17 is a section view taken along the line XVII—XVII in FIG. 15.

The detection device 700, as shown in FIGS. 16 and 17, includes a detect window 710 provided in the toner delivery path R, an elastic reflection plate 720 so disposed as to face the detect window 710, and an optical sensor 730 of a reflection type provided in the detect window 710. The optical sensor 730 is disposed in close contact with the lower surface of the detect window 710.

Figure 18B:
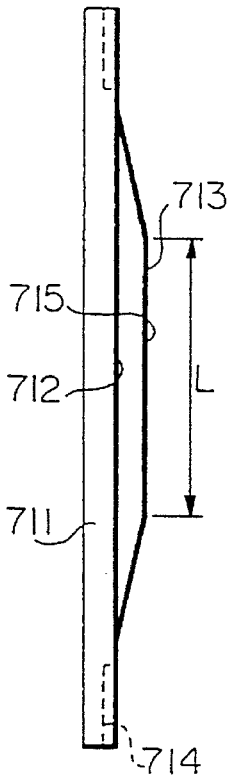
FIGS. 18(*a*)–(*c*) are detail views of a detect window employed in the invention; in particular, FIG. 18(*a*) is a front view thereof, FIG. 18(*b*) is a left side view thereof, and FIG. 18(*c*) is a bottom view.
Figure 18A:
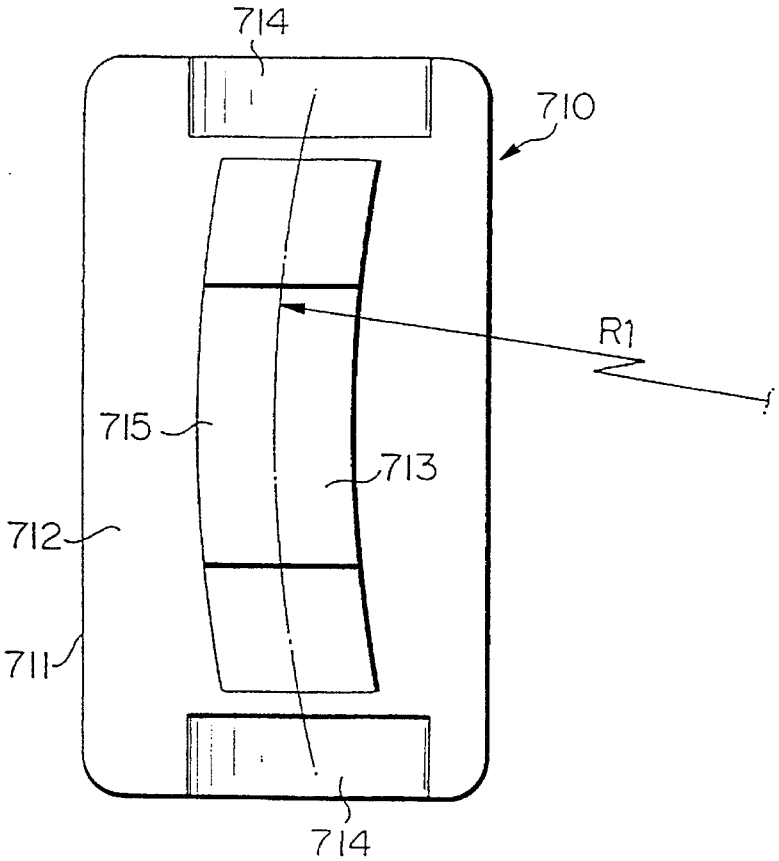
Figure 18C:
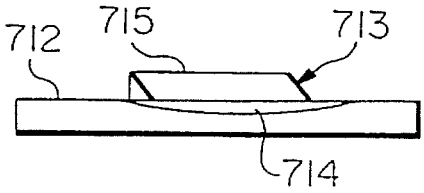

The detect window 710 is formed of a transparent material such as glass, synthetic resin, or the like. The detect window 710, as shown in FIG. 18 (a), includes a plate-like base portion 711 and a projected portion 713 formed integrally with the upper surface 712 of the base portion 711, while the upper surface of the projected portion 713 forms a projecting surface 715. The projected portion 713, as shown in FIG. 18(*a*), is curved with the same radius of curvature R1 as the portion (here, the corner portion C3) of the toner delivery path R in which the detect window 710 is disposed. As shown in FIGS. 16 and 17, the lower case 220 of the image forming unit 200 includes a recessed portion 223. By mounting the base portion 711 to the recessed portion 223, the detect window 710 can be mounted to the lower case 220.

The length L of the projecting surface 715 (see FIGS. 18(*b*) and 21(*a*)) is set to be equal to or smaller than 2 pitches of the coil spring 510.

In FIGS. 16 and 17, reference character 224 designates a smoother formed of a low friction material such as fluororesin, polyacetal or the like. In the upper surface 712 of the base portion 711, there is formed an arc-shaped recessed portion 714 in order to be able to obtain a smooth connecting condition with the smoother 224 (see FIG. 18).

In a state that the detect window 710 is mounted, the projecting surface 715 of the projected portion 713 projects a little toward the coil spring 510 rather than the smoother 224. For this reason, the coil spring 510 moves in such a manner that it is pushed and curved upwardly a little by the projecting surface 715. As a result of this, the projecting surface 715 of the detect window 710 is sure to be in sliding contact with the coil spring 510 due to a restitutive force caused by the elasticity of the coil spring 510 itself, and the toners attached to the projecting surface 715 can be wiped away. Alternatively, the projecting surface 715 may be curved upwardly in conformity with the slightly upwardly curved, moving path of the coil spring 510.

The smoother 224 is used to smooth the circulatory operation of the coil spring 510 and it is provided in a gutter shape at least in the corners C1, C2, and C3 respectively shown in FIG. 8.

Also, as shown in FIG. 17(*a*), the smoother 224 includes a side wall surface 224*a* which is capable of sliding contact with the coil spring 510 to guide the same. The side wall surface 224*a* is so inclined as to form an acute angle θ with respect to the projecting surface 715 of the detect window 710, as shown in FIG. 17(*b*). For this reason, in a contact portion 510*a* between the inclined surface 224*a* and coil spring 510, there is produced a component force which energizes the coil spring 510 toward the projecting surface 715. This makes it possible to bring the coil spring 510 into sliding contact with the projecting surface 715 more positively. For reference, in the present embodiment, the acute angle θ is set for 86°.

Figure 19:
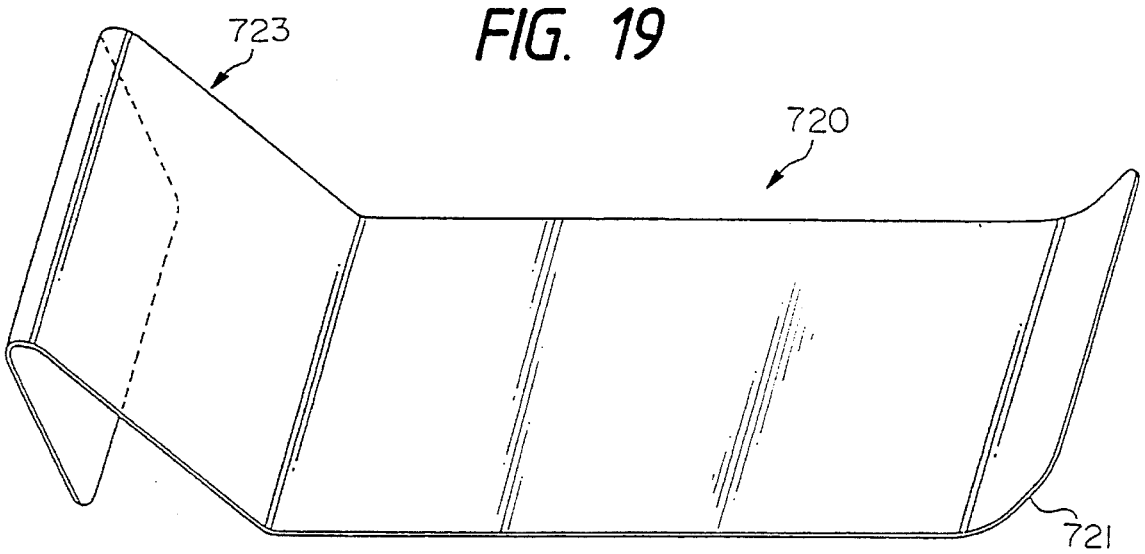
FIG. 19 is a perspective view of a reflection plate employed in the invention.

The reflection plate 720 is formed of a metal plate having a springy elasticity and, as shown in FIG. 19, it includes a curved portion 721 in the leading end portion thereof and a folded portion 723 in the trailing end portion thereof. As shown in FIG. 16, a recessed portion 233 is formed in the upper case 230 of the image forming unit 200. That is, by fitting the folded portion 723 of the reflection plate 720 into the recessed portion 233, the reflection plate 720 is mounted to the upper case 230. In the mounted state, the reflection plate 720 energizes the coil spring 510 toward the detect window 710 by means of the springy elasticity thereof.

This assures the sliding contact of the coil spring 510 with the projecting surface 715 of the detect window 710, which in turn makes it possible to wipe away the toners attached to the projecting surface 715 more positively. Also, due to the fact that the reflection surface 720 energizes the coil spring 510, the toners attached to the reflecting surface 724 (see FIG. 17) of the reflection plate 720 can also be wiped away.

Any material can be used for the reflection plane 720, provided that it has such a high reflectance as a metal shiny surface with respect to the light having a wavelength radiated by a light emitting element used in the reflection type optical sensor 730. In the present embodiment, there is used a rolled plate of SUS304 having a given springy elasticity.

At least one of, and preferably, both of, the surfaces of the detect window 710 and reflection plate 720 that may come in contact with the toners may be formed of a material which possesses the same polarity as an electrified polarity of the toners in a triboelectric series. In the present embodiment, the contact surface of the detect window 710 with the toners is formed of the material that is situated on the same polarity side with respect to the electrified polarity of the toners on the triboelectric series. The triboelectric series can be obtained in the following manner. First, two kinds of arbitrarily selected materials are electrified in contact with each other in an electrically shielded space, and the polarities of the surface potentials thus produced are measured by use of a surface potentiometer. Then, the relationships between the positive and negative polarities of the materials are ranked. When the toners are frictionally electrified to the negative polarity in use, as the material for at least the contact surface(s) of the transparent detect window 710 with the toners, preferably, the material that possesses negative polarity in the triboelectric series may be selected similarly to the toners, more preferably, the material that is equivalent to the toner or has a greater negative polarity than the toner may be selected. For example, when a negative polarity type toner formed of a polyester system binder is used, the material that has a greater negative polarity than PMMA (polymethyl methacrylate), more preferably, polyolefin or the like that possesses a greater negative polarity than the toner may be selected. On the other hand, when the toner is frictionally electrified to the positive polarity, as the material for the contact surface of the transparent detect window 710 with at least toners, preferably, the material that possesses positive polarity in the triboelectric series may be selected similarly to the toners, or more preferably, the material that is equivalent to the toner or possesses greater positive polarity than the toner may be selected. For example, when a positively electrified toner formed of a styrene-acryl copolymer system binder is used, preferably, the material that possesses greater positive polarity than polyolefin may be selected, or more preferably, the material such as polyamide or the like that is possesses greater positive polarity than the toner may be selected. In the present embodiment, since the toner is negatively electrified in use, as the material that possesses greater negative polarity in the triboelectric series than the toner, noncrystal polyolefin is used for the detect window 710. However, this is not limitative but, according to the electrified states of the toner, there can be used similarly transparent organic material such as PMMA, polyamide, melamine resin, polyurethane, SA resin, polystyrene, ABS resin, epoxy resin, polycarbonate, acrylonitrile resin, polyimide, vinyl chloride or the like, or inorganic glass such as alumina, diamond, silica or the like.

It is also preferable that a material selected according to the triboelectric series may be coated on the surface of the reflection plate 720.

At least one, preferably, all of the conductive members such as the coil spring 510, reflection plate 720 and the like may be arranged such that they are in an electrically floated condition. In the present embodiment, all of the conductive members used are arranged in an electrically floated condition. For reference, when the detect window 710 is arranged conductive, similarly, it is preferable that the detect window 710 is electrically floated.

The toners to be carried and delivered circulatingly by the coil spring 510 are frictionally electrified as they are slid along and rubbed against the coil spring 510 and the inner wall of the toner delivery path. When the conductive coil spring 510 and reflection plate 720 are grounded, then the opposite polarity electric charges to the toners are supplied to the coil spring 510 and reflection plate 720. This causes a strong attracting force to be generated between the toners and the coil spring 510 and reflection plate 720, which makes it difficult to wipe away the toners. In order to prevent this, the coil spring 510 and reflection plate 720 are electrically floated. In the electrically floated condition, the electrostatic adhesion of the toners to the reflection plate 720 can be controlled and thus, when the coil spring 510 is in sliding contact with the reflection plate 720, the toners adhered to them can be wiped away easily.

To the optical sensor 730, there are connected a detect device and an alarm device (which are not shown).

In the toner delivery path R, while the toners are being replenished from the toner tank 600, a given quantity of toners are circulating. A detect light, which is radiated from the reflection type optical sensor 730 in the detection device 700, transmits the detect window 710, passes through the toner delivery path R, is reflected by the reflection plate 720, again passes through the toner delivery path R, transmits the detect window 710, and is received by the reflection type optical sensor 730. When the optical path of the detect light is shielded by the given quantity of toners under circulation, then the reflection type optical sensor 730 outputs an output signal which corresponds to the fact of "no reflection light".

When the toners are greatly reduced or run out in the portion of the toner delivery path where the detection device 700 is disposed, there occurs a state that the optical path of the detect light cannot be shielded. Especially, in a state that the toners run out, the optical path of the detect light is simply shielded temporarily by the coil spring 510. Therefore, the reflection type optical sensor 730 outputs an output signal corresponding to the detection of the reflected light and, especially, when the toners run out, there is output a repeat signal which corresponds to ½ pitches of the coil spring 510.

Accordingly, the output signals output from the optical sensor 730 are being monitored by the detect device (not shown) connected to the optical sensor 730. When the above-mentioned repeat signals are successively output for a given time and at a given probability, this can be detected as no toner is left in the toner delivery path R.

Also, in this case, an alarm sound is issued from the alarm device and/or a message is displayed on a display device (not shown), thereby informing a user of the fact that no toner is left (to be exact, the fact that the toners in the toner tank 600 run out and the quantity of toners in the developing device 300 is starting to decrease).

According to the above-mentioned printer, the following operation effects can be obtained:

(i) The toners are supplied onto the surface of the photosensitive member 201 by the developing device 300 and the latent image on the surface of the photosensitive member 201 is developed by the toners to form a toner image. After the toner image is transferred to the recording paper P, the residual toners adhered to the surface of the photosensitive member are removed and collected by the cleaning device 400.

Between the developing device 300 and cleaning device 400, there is interposed the toner delivery device 500 in a closed loop, by which delivery device 500 delivers part of the surplus toners that have not been used for development in the developing device 300 to the cleaning device 400, and the residual toners collected by the cleaning device 400 are delivered to the developing device 300. At the same time, new toners are replenished to the toner delivery path R by the toner tank 600. As a result, normally, a given quantity of toners are circulating through the developing device 300, cleaning device 400 and toner delivery path R. Therefore, if the toners are consumed in the developing device 300, normally, a quantity of toners corresponding to the quantity of toners consumed are then replenished through the toner delivery path 500.

However, if the toner tank 600 becomes empty and new toners are supplied from the toner tank 600 no longer, then the quantity of the toners existing in the toner delivery path R decreases gradually and, in the end, the quantity of the toners in the toner delivery path R decreases greatly when compared with the normal quantity of toners and the toners almost run out in the path R.

Figure 20A:
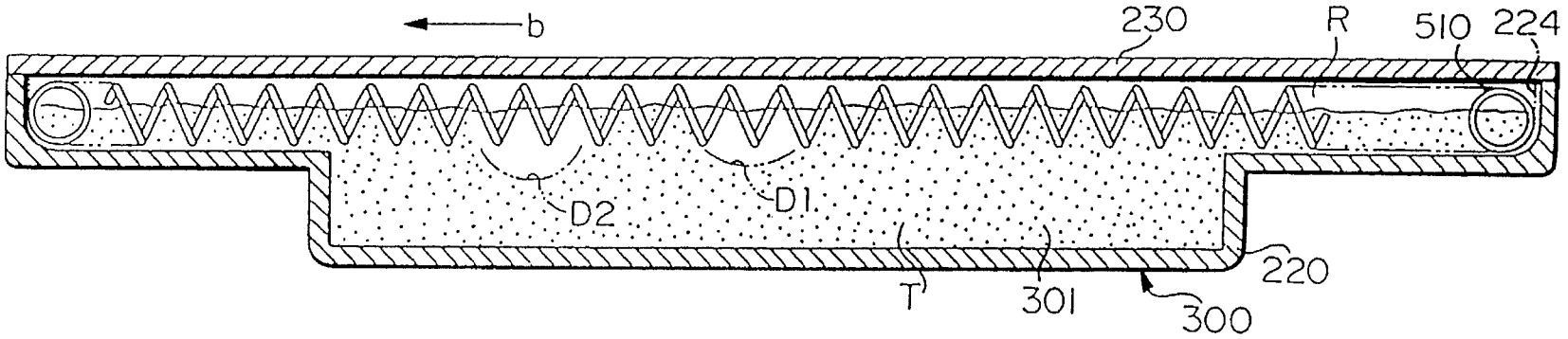
FIGS. 20(*a*) and (*b*) are respectively general section views taken along the line XX—XX in FIG. 8, showing different states of the toner in a developing device.
Figure 20B:
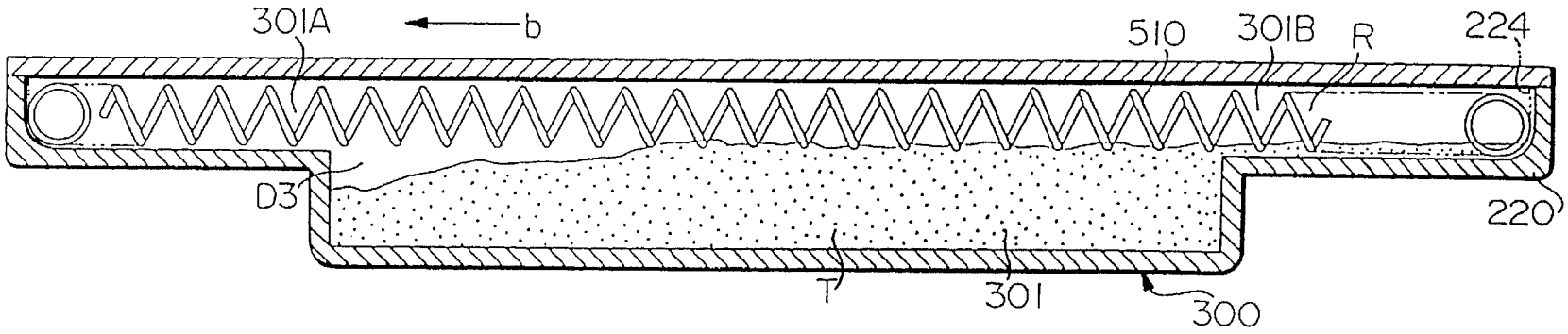

Now, FIGS. 20(*a*) and (*b*) are respectively schematic section views taken along the line XX—XX in FIG. 8, showing how the toners T within the developing device run out from the normal state thereof.

In particular, FIG. 20(*a*) shows a state that new toners are being supplied to the toner delivery path R from the toner tank 600, in which a given quantity of toners are circulating in the toner storage chamber 301 of the developing device 300 and the toner delivery path R. Since the toners T are delivered on the toner storage chamber 301 along the longitudinal direction thereof by the coil spring 510, even if the toners are consumed in part in the toner storage chamber 301 and thus the quantity level of the toners is lowered, toners are replenished as occasion demands by means of free drop (free flow-down) of the toners from the coil spring 510 to the level lowered portions, for example, portions D1 and D2 respectively by imaginary lines in FIG. 20(*a*). Therefore, even if the toners are consumed in the developing device 300, a quantity of toners equivalent to the quantity of the toners consumed are replenished through the toner delivery path R to the developing device 300, thereby being able to maintain an even level of the toners T in the toner storage chamber 301. Here, if the level of the toners is lowered in two or more portions (for example, D1, D2), supply of new toners begins at the portion (D1) located most upstream, that is, the toners are supplied sequentially from upstream to downstream, thereby evening the level of the toners.

On the other hand, FIG. 20(*b*) shows a state after the elapse of some time since the toner tank 600 has run out of the toners and new supply of toners from the toner tank 600 has been stopped.

Just after the supply of new toners from the toner tank 600 is stopped, a given quantity of toners are still left in the toner delivery path R. Therefore, even if the toners are consumed in the developing device 300, while the same quantity of toners as the toners consumed are present in the toner delivery path R, the toners are replenished in the above-mentioned manner so that the toners T in the toner storage chamber 301 can be kept almost level.

However, if the toners are further consumed and the quantity of the toners existing in the toner delivery path R becomes smaller than the quantity of the toners consumed in the developing device 300, the toners in the toner storage chamber 301 begin to decrease in quantity on the downstream side of the toner delivery path. A portion in which the quantity of the toners decreases is shown by D3 in FIG. 20(*b*). The toner quantity begins to decrease on the downstream side because the replenishment of the toners to the toner storage chamber 301 is performed sequentially from the upstream side to the downstream side.

As a result of the toners in the toner storage chamber 301 decreasing in quantity from the downstream side of the toner delivery path in this manner, the toners in the toner delivery path R run out first in a portion 301A just downstream of the toner storage chamber 301, the depletion state advances sequentially along the circulation direction of the coil spring 510, and, when the depletion state reaches a portion 301B upstream of the toner storage chamber 301, then the toners almost run out in the toner delivery path R. In this case, unless the quantity of consumption of the toners in the developing device is excessively great, a given quantity of toners are still left in the toner storage chamber 301 and are used for development, and the residual toners thereof are collected by the cleaning device 400. The collected toners are then delivered to the developing device 300 by the delivery device and, therefore, there exist some toners (a very small quantity of toners when compared with the normal quantity of toners used) in the delivery path extending from the cleaning device 400 to the developing device 300.

As described above, in the present embodiment, if the new toners are not supplied from the toner tank 600 any longer, then the toners in the toner delivery path R firstly run out before the toners in the developing device 300 run out.

According to the image forming equipment of the present embodiment, since the detection device 700 for detecting the fact that the toners run out is provided with respect to the toner delivery path R, it is possible to detect the residual quantity of the toners positively without increasing the size of the developing device 300.

The term "to detect the residual quantity of the toners" used here does not mean to detect the residual toners quantitatively, for example, how many grams of toners are left. Instead, the present invention detects if the toners in the image forming equipment are left only in such a quantity that cannot satisfy the necessary quantity of the toners to be normally present in the developing device 300.

(ii) As described above, according to the present image forming equipment, if the new toners are not supplied from the toner supply means any longer, then the toners in the toner delivery path R first run out before the toners in the developing device 300 run out. And in the toner delivery path R, the toners begin to run out first at the portion of the path R situated downstream of the developing device 300.

Also, according to the image forming equipment of the present embodiment, since the detection device 700 is disposed downstream of the developing device 300 and upstream of the cleaning device 400, the residual quantity of the toners can be detected more positively and quickly.

The position of the detection device 700 is not limited to the downstream side of the developing device 300 but the detection device 700 may be situated upstream of the developing device 300. In this case as well, since the toners in the delivery path R run out first before the toners in the developing device 300 run out, the residual quantity of the toners can be detected positively. However, when the detection device is located downstream of the cleaning device 400 and upstream of the developing device 300, some quantity of the toners collected from the cleaning device 400 are present in the toner delivery path R and, therefore, the detect accuracy may be lowered depending on the structure of the detection device.

On the other hand, according to the present embodiment, since the detection device 700 is disposed downstream of the developing device 300 and upstream of the cleaning device 400, the residual quantity of the toners can be detected more positively.

Also, when the detection device is disposed downstream of the toner supply port 243 and upstream of the developing device 300, the new toners that are supplied just after replacement of the toner tank 600 are detected and, therefore, in spite of the fact that a sufficient quantity of toners are not present in the developing device 300, there is a possibility that the detection device detects or judges that a sufficient quantity of toners are present there.

On the other hand, according to the present embodiment, since the detection device 700 is disposed downstream of the developing device 300 and upstream of the cleaning device 400, the residual quantity of toners can be detected more positively and quickly without incurring such inconvenience as mentioned above. That is, according to the present embodiment, the detection device 700 is provided at a position where the toners are delivered first just after the toner storage chamber 301 of the developing device 300 is filled with the toners and, therefore, the detection device 700 is able to detect the quantity of the toners very positively.

(iii) According to the present embodiment, since the sensor is formed of the optical sensor 730, it is possible to control the variations in the output signals with respect to environmental noises produced by the peripheral mechanisms of the detection device 700, such as vibrations caused by driving of devices, variations in temperatures and humidity, and the like. Because of this, in forming successive images for a long period of time and in forming images under the high temperature and high humidity environment or under the low temperature and low humidity environment, the detection device 700 is not likely to malfunction, so that there can be obtained highly reliable detect result.

(iv) The coil spring 510 moves in sliding contact with the detect window 710, and the sliding contact of the coil spring 510 makes it possible to wipe away the toners adhered to the upper surface 715 of the detect window 710.

Because of this, the light to transmit the detect window 710 is not shielded by the toners and thus whether the toners are present or not in the toner delivery path R can be detected with high reliability.

In other words, according to the present image forming equipment, since the coil spring 510 forms toner wiping means for the detect window 710, the detection device 700 can be wiped without providing special wiping means (such as a wiper or the like) and a positive detect operation can be achieved.

Further, in the present embodiment, since the detect window 710 includes the projecting surface 715 which projects toward the coil spring 510, the projecting surface 715 is sure to be in sliding contact with the coil spring 510 due to the restitutive force caused by the elasticity of the coil spring 510 itself. This sliding contact action enables the toners adhered to the projecting surface 715 to be wiped away more completely, which prevents the light to be transmitted through the detect window 710 from being erroneously shielded by the toners. Therefore, it is possible to detect with high reliability whether the toners are present in the toner delivery path R or not.

(v) Since the reflection plate 720 energizes the coil spring 510 toward the detect window 710, the above toner wiping operation can be performed further positively without requiring any other energizing means than the reflection plate 20. And, as the result that the reflection plate 720 energizes the coil spring 510, the toners adhered to the reflecting surface 724 of the reflection plate 720 can be wiped away, which makes it possible to detect the presence or absence of the toners in the toner delivery path with higher reliability.

Also, according to the present structure, since it is not necessary to wipe away the toners from the detect surface by use of means having a strong stirring ability such as a wiper or the like, such excessive stresses that can lower an image quality are not applied to the toners. Thus, the present invention possesses a stabilized image quality. The pressure force to be applied between the coil spring 510 and the detect surface may be preferably set in the range of 2 to 200 gf and, more preferably, in the range of 5 to 50 gf.

(vi) Since the length L of the projecting surface 715 in the toner delivery direction is equal to or less than 2 pitches (2 p) of the coil spring 510, a further positive sliding contact operation can be obtained between the projecting surface 715 and coil spring 510.

Figure 21A:
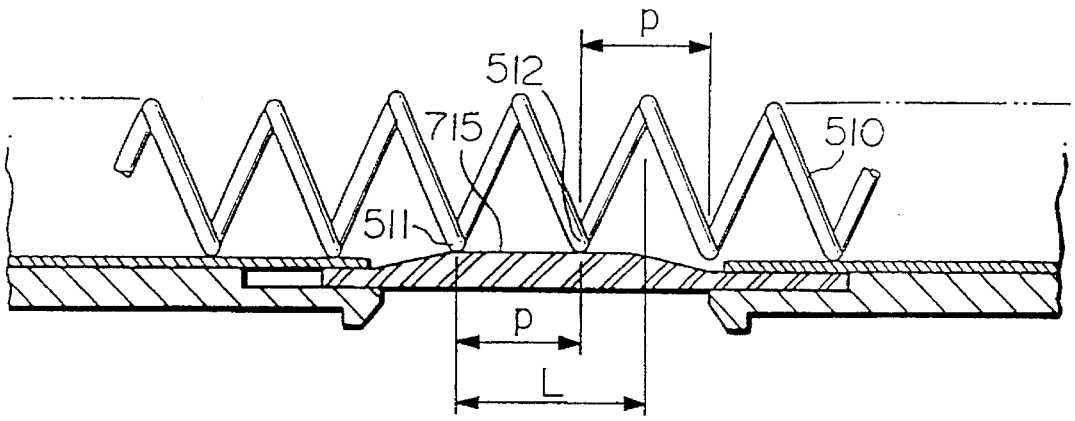
FIGS. 21(*a*) and (*b*) are respectively explanatory views of the detection operation to be performed by the invention.
Figure 21B:
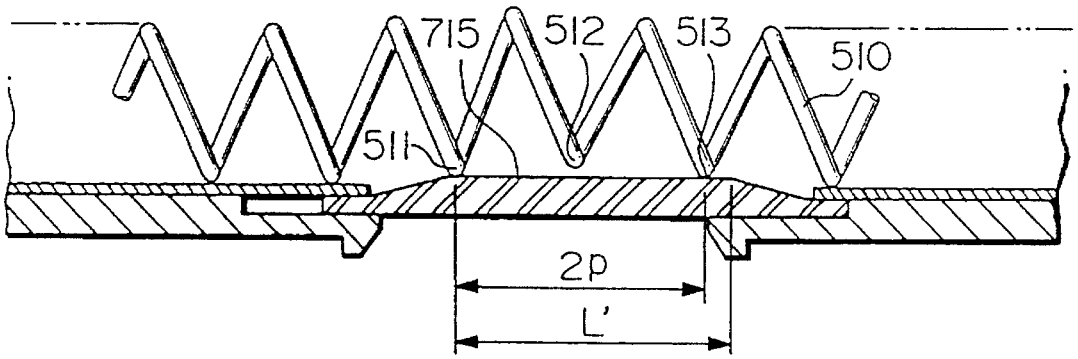

FIG. 21(*b*) illustrates what happens if the length L' of the projecting surface 715 in the toner delivery direction is more than 2 pitches (2 p) of the coil spring 510. When three portions 511, 512, and 513 where the coil spring 510 must be in sliding contact with the projecting surface 715 due to some curving and allowance of the coil spring 510, or due to the fact that the coil spring 510 moves while it is pushed up and thus curved slightly upwardly by the projecting surface 715, are provided, the central portion 512 floats up from the projecting surface 715 as shown in FIG. 21(*b*). Thus, there is a possibility that a positive sliding contact condition cannot be always obtained.

On the other hand, according to the present embodiment, as shown in FIG. 21(*a*), since the length L of the projecting surface 715 in the toner delivery direction is equal to or less than 2 pitches (2 p) of the coil spring 510, even if the coil spring 510 has some curving or allowance, or even if the coil spring 510 moves while it is slightly pushed up and thus curved upwardly, the number of the portions of the coil spring 510 where it must be in sliding contact with the projecting surface 715 is at the most 2 (the two portions are designated by 511, 512, respectively). Therefore, the coil spring 510 can never float up from the projecting surface 715, so that a positive sliding contact condition can be obtained.

(vii) As shown in FIG. 17(*b*), since the side wall surface 224*a* capable of sliding contact with the coil spring 510 to guide the same is so inclined as to form an acute angle θ with respect to the projecting surface 715, in the contact portion 510*a* between the inclined surface 224*a* and coil spring 510, a component force which energizes the coil spring 510 toward the projecting surface 715 is generated. As a result, the coil spring 510 can come into sliding contact with the projecting surface 715 more positively, and better detection results are possible.

(viii) Because the contact surface of the detect window 710 with the toner is formed of the material that is situated on the same polarity side on the triboelectric series with respect to the electrified polarity of the toner, the toners existing in the toner delivery path do not easily adhere electrostatically to the detect window 710. For this reason, the light to transmit the detect window 710 is difficult to be shielded by the toners, which makes it possible to detect with high reliability whether the toners are present in the toner delivery path or not. And, since the above-mentioned toner wiping operation by the coil spring 510 in the contact surface of the detect window 710 with the toners can be performed more easily, the presence or absence of the toners in the toner delivery path can be detected more positively.

(ix) Since the coil spring 510 and reflection plate 720 are both electrically floated, the toners are difficult to adhere electrostatically to the coil spring 510 and reflection plate 720, which facilitates the toner wiping operation. Therefore, it is possible to detect positively whether the toners are present in the toner delivery path or not.

(x) If a toner absence condition is detected by the optical sensor 730, then the alarm device informs the user of this condition, and the user can replace the toner tank 600 properly.

In this state, as described before, normally, since a given quantity of toners are still left in the developing device 300 and are used for development, the printing operation on the recording paper can be continued. And, since the exposed portion 600A of the toner tank 600 is exposed externally of the main body case 101 out of the moving path of the recording paper P, by gripping and rotating the exposed portion 600A while performing the printing operation, the toner tank 600 can be replaced easily in a short time.

That is, for example, when the toners are going to run out while documents including a large number of sheets of recording paper are under printing, the toner absence message is issued beforehand and, responsive to this, the user can replace the toner tank 600 without interrupting the printing operation, that is, the user can continue the printing operation without interruption even during the replacement of the toner tank 600.

(xi) As described above, since at the time when the toners in the developing device 300 begin to decrease in quantity, this can be detected, it is possible to prevent occurrence of a condition that the toners in the developing device 300 are greatly reduced in quality or run out. This prevents the toners or foreign substances such as paper powder or the like from adhering to the regulation blade 330 portion.

That is, the developing device 300 is structured such that a given developing operation can be performed in a condition that a predetermined quantity of toners are present in the toner storage chamber 301. When the quantity of the toners in the toner storage chamber 301 is extremely small or the toners run out, not only can a good developing operation not be performed but also damage can occur due to the extremely small quantity or absence of the toners. For example, when the quantity of the toners in the toner storage chamber 301 is extremely small, during the above-mentioned operation of the developing device 300, the toners cannot be coated uniformly onto the developing roller 320 by the supply roller 310, and the toners on the surface of the developing roller 320 cannot be turned into an even thin layer and cannot be frictionally electrified uniformly in the image forming width direction. As a result of this, the toners partially coated on the developing roller 320 can suffer from unbalanced sliding contact in the sliding contact portion of the regulation blade 330 and can be fixed there forcibly, or a small quantity of strange substances such as paper powder or the like mixed into the toner storage chamber 301 can be coated on the developing roller 320 to cause clogging in the sliding contact portion of the regulation blade 330. When such fixing and clogging occur, even if toners are replenished after such phenomena, they cannot be returned to their original conditions, so that a good image formation cannot be realized.

On the other hand, according to the image forming equipment of the present embodiment, as described above, since decrease in the quantity of the toners can be detected at the time when the quantity of the toners begins to decrease, it is possible to prevent the above-mentioned inconveniences.

Description will now be given of a modification of the above-mentioned embodiment. In the modification, the same parts (including equivalent parts depending on the situation) as those in the above-mentioned embodiment are given the same reference characters in the following description.

Figure 22:
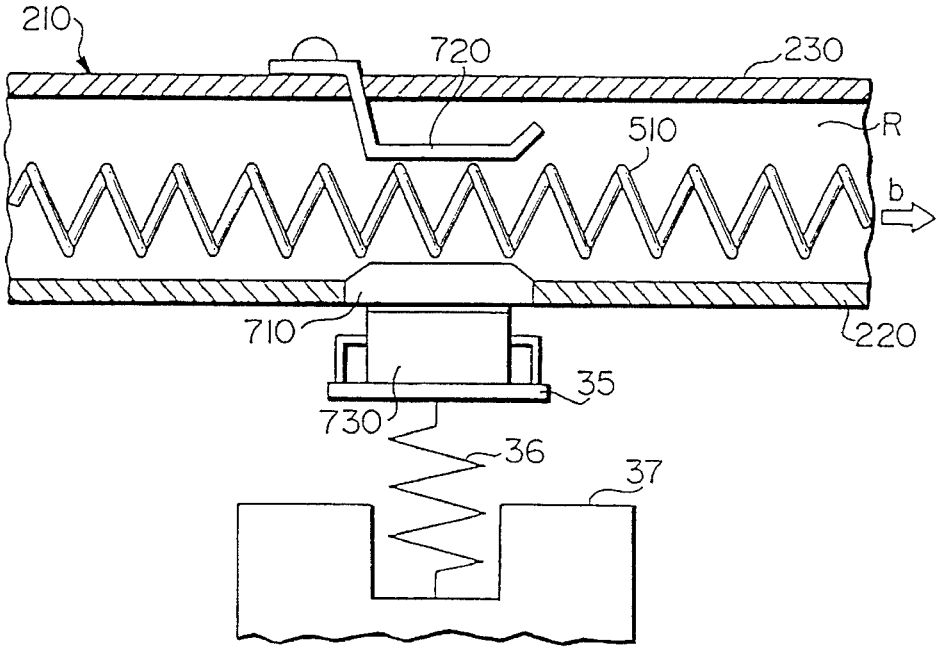
FIG. 22 is an explanatory view of a modification of the above embodiment.

FIG. 22 is a typical view of the modification relating to the provision of the mechanism of detection device, in which a reflection type optical sensor 730 is movably supported in the main body of a recording device in such a manner that the element surface of the reflection type optical sensor 730 is able to followingly approach or stick to the surface of the detect window 710 disposed in a portion of the toner delivery path R of the image forming equipment. A sensor support base member 35 is a member which is used to support and fix the reflection type optical sensor 730 directly. Between the sensor support base member 35 and a main body support base member 37 fixed to the printer main body, there is interposed a coil spring 36 so that the reflection type optical sensor 730 is free to move in a range where the coil spring 36 is elastically deformable with respect to the printer main body. Therefore, even in a structure in which a case 210 including the detect window 710 is easy to be shifted in portion, since the element surface of the reflection type optical sensor 730 is able to followingly approach or stick to the surface of the detect window 710, not only large dimensional tolerances can be obtained for the component parts but also the case 210 including the detect window 710 can be removed from and mounted to the sensor 730. In the present embodiment, the coil spring 36 is interposed between the sensor support base member 35 and main body support base member 37 so that the reflection type optical sensor 730 is free to move. However, the invention is not limited to the coil spring 36 but, as an urging member capable of performing a similar function to the coil spring 36, there can be used a plate spring, soft rubber, soft foam, or the like. By structuring the toner residual quantity detection device in this manner, the image forming equipment can be freely removed from and mounted to the printer main body 100.

The reason why the detect window 710 is so disposed as to be approachable or stickable to the reflection type optical sensor 730 is to reduce flare light produced as a result of part of the light emitted from the light emitting element of the reflection type optical sensor 730 is reflected by the inner surface of the detect window 710. The flare light must be reduced sufficiently with respect to the reflected light from the optical reflection plate 720 to be received by a light receiving element. If the flare light that provides a noise signal is approximate to the reflected light from the reflection plate 720, which provides a normal signal, then the S/N ratio is lowered. Therefore, even if the toners run short on the toner detect surface, it is difficult to detect this short condition as the toner absence condition because the resolution of the detect signal is low.

Figure 23:
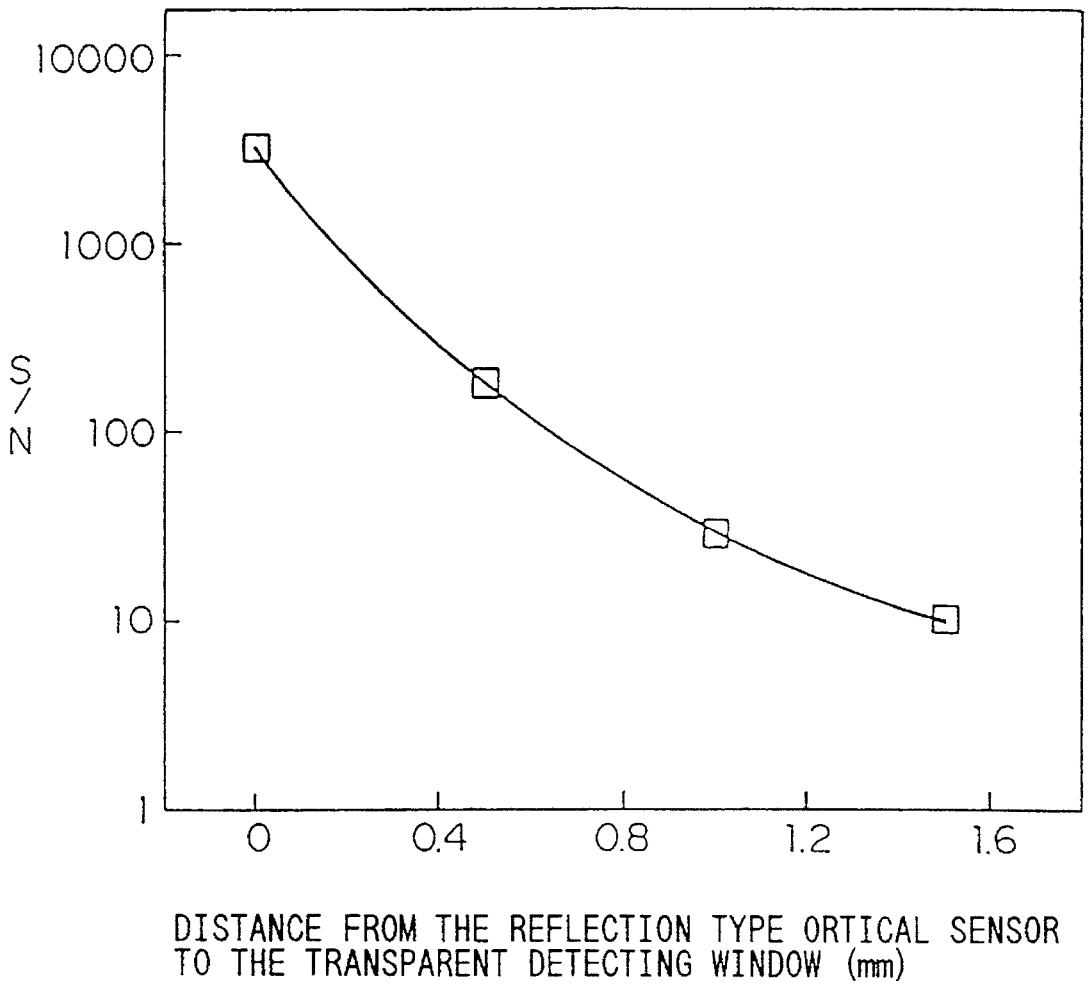
FIG. 23 is a graphical representation of a relationship of an S/N ratio with respect to the distance between an optical sensor of a reflection type and a detect window.

Now, FIG. 23 is a graphical representation which shows a relationship between the S/N ratio and the distance from the reflection type optical sensor 730 to the detect window 710 respectively used in the detection device in the above modification. The relationship holds also in the previously-described embodiment.

The abscissa of FIG. 23 expresses a distance between the reflection type optical sensor 730 and the detect window 710, while the ordinate expresses a ratio between a normal signal provided by the reflected light from the reflection plate 720 and a noise signal provided by the flare light, in the form of S/N.

Since the S/N ratio lowers greatly as the distance increases and the S/N ratio is 10 or less if the distance is 1.5 mm or larger, it is difficult to detect the toner absence condition under this condition. In consideration of the manufacturing variations, environmental variations and aging variations of the respective elements forming the reflection type sensor 730, the S/N ratio required for detection of the toner absence condition must be 10 or more, preferably, 100 or more. Therefore, the distance between the reflection type optical sensor 730 and detect window 710 that satisfies the above-mentioned S/N ratio is less than 1.5 mm and, preferably, may be less than 0.6 mm. In the above-mentioned embodiment, as the reflection type optical sensor 730, there is used a photo-microsensor (model EE-SY 110, manufactured by Omron Co., for example). However, this is not limitative, and other light emitting/receiving elements can be used in combination, or a sensor which does not include an integral package of two light emitting and receiving elements can also be used. Also, with respect to the distance between the reflection type optical sensor 730 and detect window 710 required as the condition to satisfy the S/N ratio 10 or more, although the required value of the distance may vary according to the distance between the light emitting and receiving elements, the angles of the light emitting and receiving elements relative to the reflection plate 720 and the like, in fact, it is preferable that the distance between the reflection type optical sensor 730 and detect window 710 is reduced as much as possible. When the distance between the reflection type optical sensor 730 and detect window 710 cannot be reduced, it is also possible to interpose a light shield cover or the like for prevention of the flare light between the light emitting and receiving elements in order to reduce the quantity of the flare light to be received by the light receiving element.

In the above-mentioned embodiment, the reflection plate 720 itself is formed of a metal plate having a springy elasticity. However, alternatively, other kinds of structures may also be used. For example, by supporting and pressing an optical reflection plate, which is a rigid member, by use of elastic means such as a coil spring, soft rubber, soft foam or the like, a similar effect can be obtained.

Figure 24A:
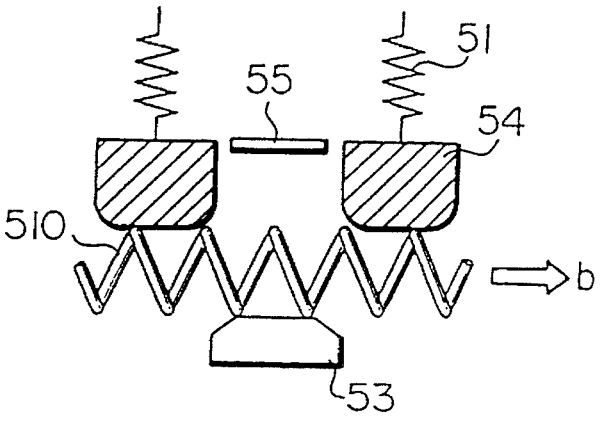
FIGS. 24(*a*), (*b*) and (*c*) are respectively explanatory views of another modifications.
Figure 24B:
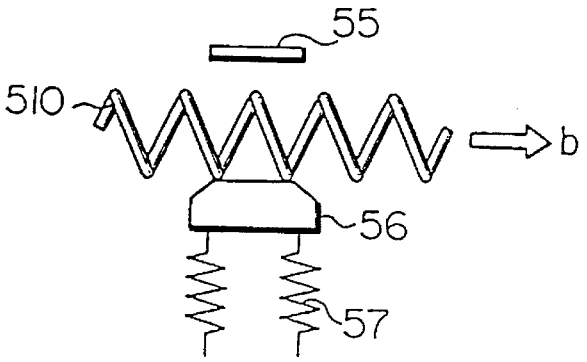
Figure 24C:
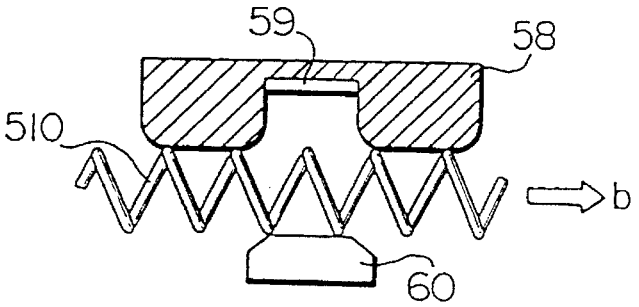

FIGS. 24(*a*)–(*c*) are typical views of modifications of the mechanism of the pressure means which presses against the coil spring 510 and the transparent detect window of the detection device.

In particular, FIG. 24(*a*) shows the structure of pressure means using a support spring 51 which presses the coil spring 510 through a pressure member 54 against a transparent detect window 53. In this figure, reference character 52 designates a reflection plate.

FIG. 24(*b*) shows the structure of pressure means which presses the coil spring 510 through a transparent detect window 56 by means of the pressure of a support spring 57. In this figure, 55 stands for a reflection plate.

FIG. 24(*c*) shows the structure of pressure means which presses the coil spring 510 against a transparent detect window 60 by use of a pressure member 58. In this figure, 59 designates a reflection plate.

While description has been given heretofore of the embodiment and its modifications according to the invention, the present invention is not limited to the above-mentioned embodiment and its modifications, but other various modifications and changes are also possible without departing from the scope of the subject matter of the invention.

For example, the sensor of the detection device is not limited to the optical reflection type sensor but a transmission type sensor can also be used. In this case, a transparent detect window is provided instead of the reflection plate.

Further, the detection device is not limited to the optical detect type but an inductance detect type, an electrostatic capacitance detect type, a current detect type, a leakage magnetic flux detect type can also be used. That is, any type of detection device can be used, provided that it is able to detect the fact that the toners run out in the toner delivery path.

What is claimed is:

1. Image forming equipment, comprising:

a developing device, in contact with a photosensitive member, supplying toners onto a surface of said photosensitive member and developing a latent image on said surface of said photosensitive member, thereby forming a toner image;

a cleaning device, disposed downstream from said developing device in sliding engagement with said photosensitive member, that removes and collects residual toners adhered to said surface of said photosensitive member after said toner image formed by said developing device is transferred to paper;

a toner delivery device, interposed in a closed loop between said developing device and said cleaning device, delivering a portion of surplus toners not used for development in said developing device to said cleaning device, and delivering said residual toners collected by said cleaning device to said developing device;

toner supply means for replenishing toners to a toner delivery path in said toner delivery device; and a detection device, disposed along said toner delivery path, detecting toner depletion.

2. Image forming equipment as set forth in claim 1, wherein said detection device is disposed downstream of said developing device and upstream of said cleaning device.

3. Image forming equipment as set forth in claim 1, wherein said detection device comprises a detect window provided in said toner delivery path and an optical sensor provided in said detect window.

4. Image forming equipment as set forth in claim 3, wherein said detect window is electrically floated.

5. Image forming equipment as set forth in claim 3, wherein at least a surface of said detect window that contacts said toners is formed of a material having the same polarity as an electrified polarity of said toners in a triboelectric series.

6. Image forming equipment as set forth in claim 3, wherein said toner delivery device includes a toner delivery member movable circulatingly between said developing device and cleaning device, and said toner delivery member moves in sliding contact with said detect window.

7. Image forming equipment as set forth in claim 6, wherein said toner delivery member is electrically floated.

8. Image forming equipment as set forth in claim 6, wherein said detection device comprises a detect window provided in said toner delivery path, an elastic reflection plate disposed facing said detect window, and an optical sensor of a reflection type provided in said detect window, and said reflection plate urges said toner delivery member toward said detect window.

9. Image forming equipment as set forth in claim 8, wherein said toner delivery path includes a side wall surface capable of sliding contact with said toner delivery member to guide said toner delivery member, and at least the surface portion of said side wall surface situated adjacent to said detect window is inclined so as to form an acute angle with respect to a surface of said detect window facing said toner delivery path.

10. Image forming equipment as set forth in claim 8, wherein said reflection plate is electrically floated.

11. Image forming equipment as set forth in claim 8, wherein at least a surface of said reflection plate that contacts said toners is formed of a material having the same polarity as an electrified polarity of said toners in a triboelectric series.

12. Image forming equipment, comprising:

a developing device, in contact with a photosensitive member, supplying toners onto a surface of said photosensitive member and developing a latent image on said surface of said photosensitive member, thereby forming a toner image;

a cleaning device, disposed downstream from said developing device in sliding engagement with said photosensitive member, that removes and collects residual toners adhered to said surface of said photosensitive member after said toner image formed by said developing device is transferred to paper;

a toner delivery device, interposed in a closed loop between said developing device and said cleaning device, delivering a portion of surplus toners not used for development in said developing device to said cleaning device, and delivering said residual toners collected by said cleaning device to said developing device;

toner supply means for replenishing toners to a toner delivery path in said toner delivery device; and an elastic toner delivery member, circulatingly movable in said toner delivery path in said toner delivery device;

a transparent detect window disposed in said toner delivery path and including a projecting surface projecting toward said elastic toner delivery member; and an optical sensor provided in said detect window.

13. Image forming equipment as set forth in claim 12, wherein said optical sensor is disposed downstream of said developing device and upstream of said cleaning device.

14. Image forming equipment as set forth in claim 12, wherein said elastic toner delivery member comprises a coil spring, and wherein the length of said projecting surface of said detect window in the toner delivery direction is equal to or less than 2 pitches of said coil spring.

15. Image forming equipment as set forth in claim 12, wherein at least said projecting surface of said detect window is formed of a material possessing the same polarity as an electrified polarity of said toners in a triboelectric series.

16. Image forming equipment as set forth in claim 12, wherein said elastic toner delivery member is electrically floated.

17. Image forming equipment as set forth in claim 12, wherein said detect window is electrically floated.

18. Image forming equipment as set forth in claim 12, wherein said optical sensor comprises an optical sensor of a reflection type, an elastic reflection plate is provided at a position facing said detect window with said elastic toner delivery member between said reflection plate and said detect window, and said reflection plate energizes said elastic toner delivery member toward said detect window.

19. Image forming equipment as set forth in claim 18, wherein said reflection plate is electrically floated.

20. Image forming equipment as set forth in claim 18, wherein at least a surface of said reflection plate that contacts said toners is formed of a material possessing the same polarity as an electrified polarity of said toners in a triboelectric series.

21. Image forming equipment as set forth in claim 18, wherein said toner delivery path includes a side wall surface capable of sliding contact with said elastic toner delivery member for guiding said elastic toner delivery member, and at least the surface portion of said side wall surface situated adjacent to said detect window is so inclined as to form an acute angle with respect to said projecting surface of said detect window.

* * * * *